US006820567B1

(12) United States Patent
Kishi et al.

(10) Patent No.: US 6,820,567 B1
(45) Date of Patent: Nov. 23, 2004

(54) STEERING DEVICE

(75) Inventors: Seiichi Kishi, Kobe (JP); Tsukasa Yoshida, Kobe (JP); Nobuyasu Takahashi, Kobe (JP); Kenji Ito, Kobe (JP); Kenichi Sonoda, Kobe (JP)

(73) Assignees: Marol Co., Ltd., Hyogo (JP); The New Industry Research Organization, Hyogo (JP)

( * ) Notice: Subject to any disclaimer, the term of this patent is extended or adjusted under 35 U.S.C. 154(b) by 44 days.

(21) Appl. No.: 10/070,917

(22) PCT Filed: Jul. 7, 2000

(86) PCT No.: PCT/JP00/04573

§ 371 (c)(1),
(2), (4) Date: Mar. 20, 2002

(87) PCT Pub. No.: WO01/19670

PCT Pub. Date: Mar. 22, 2001

(30) Foreign Application Priority Data

Sep. 13, 1999 (JP) ..... 11/258566

(51) Int. Cl.[7] ..... B63H 25/22
(52) U.S. Cl. ..... 114/150; 440/61 S
(58) Field of Search ..... 114/150; 440/61 R, 440/61 S, 61 A

(56) References Cited

U.S. PATENT DOCUMENTS 2,601,405 A * 6/1952 Link ..... 60/328
3,400,537 A * 9/1968 Mercier ..... 60/384

* cited by examiner

*Primary Examiner*—Sherman Basinger
(74) *Attorney, Agent, or Firm*—William H. Holt

(57) ABSTRACT

A helm pump (10) rotated either in forward or reverse direction by operating a steering wheel (13) and discharges a liquid of a quantity proportional to the rotating angle, and a double action cylinder moves a rudder (27) and is provided on rudder (27) side of the ship, helm pump (10) and the double action cylinder being connected with the hydraulic circuit of fully closed construction, to move the rudder (27) by an amount corresponding to the amount of liquid discharged from the helm pump (10). A second pump generates discharging pressure in the same direction as the discharging direction from helm pump (10) against resistive pressure generated by the rotation of helm pump (10) due to the operation of steering wheel (13) is installed in series in part of the fully closed hydraulic circuit, so the steering resistance of steering wheel (13) is automatically reduced by the action of the second pump.

16 Claims, 28 Drawing Sheets

$P_1$: Differential pressure $N_r$: Rotating speed $P_r$: Load pressure

A, B, d, e, f, m, k: Constants specific to apparatus c: Adjustable constant s: Laplacian FIG. 25
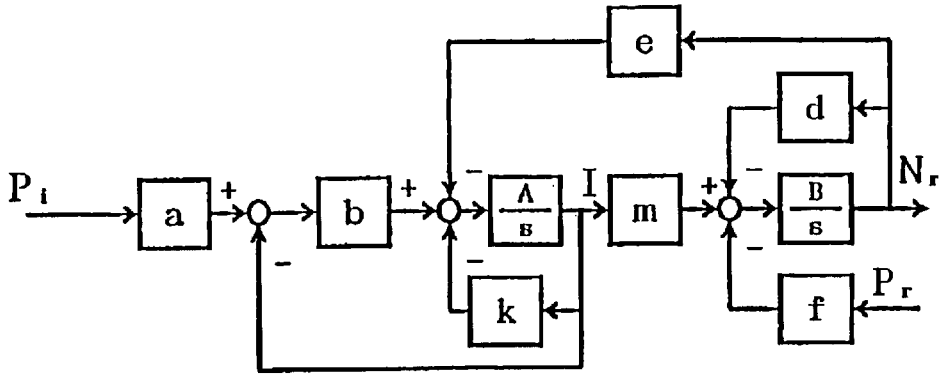
$P_i$: Differential pressure
$N_r$: Rotating speed
$P_r$: Load pressure
A, B, d, e, f, m, k: Constants specific to apparatus
a, b: Adjustable constant
s: Laplacian
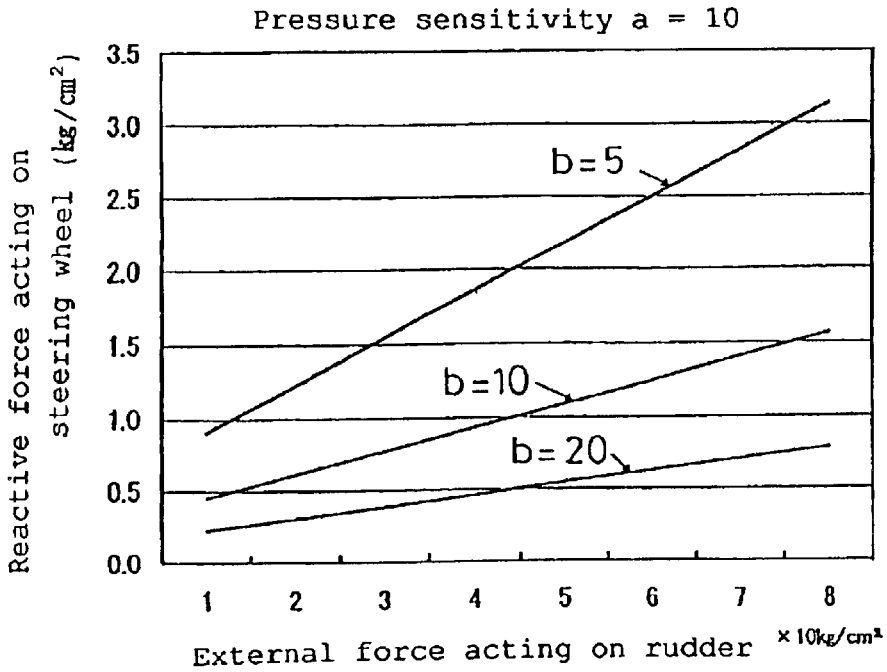
FIG. 26

STEERING DEVICE

TECHNICAL FIELD

The present invention relates to a steering apparatus, and principally to a steering apparatus that can be used preferably as the steering apparatus of a ship.

BACKGROUND ART (1) A Manual Steering Apparatus that Uses a Helm Pump

By taking reference to FIG. 28, a manual steering apparatus of the prior art using a pump that can be rotated either in forward or reverse direction and can discharge a liquid (oil) of a quantity proportional to the rotating angle (hereinafter referred to as a helm pump) will be described below with reference to FIG. 28. This apparatus has a steering wheel 13 as steering means and a hemp pump 10 provided on the steersman side and a double action cylinder mechanism provided on the rudder side of the ship as means to drive the rudder 27. The steering means and the double action cylinder mechanism are connected with a hydraulic channel 14 that consists of a pair of hydraulic circuits 14*a*, 14*b*, so as to constitute a hydraulic circuit a fully closed circuit construction as a whole.

When the steersman turns the steering wheel 13 so that a liquid is discharged from a right port 11 of the helm pump 10, for example, the liquid discharged from a right port 11 of the helm pump 10 enters a right chamber 25 of a cylinder through the hydraulic circuit 14*a* and a right port 23 of a double action cylinder 20, so as to push a piston 21 to move in a direction depicted as leftward in the drawing. This causes the rudder 27 to be steered via a piston rod 22, thereby effecting the steering operation.

When the piston 21 is pressed to move to the left in the double action cylinder 20, accordingly the liquid contained in the left chamber 26 of the cylinder is forced through the left port 24 into the hydraulic circuit 14*b*, so that the liquid in the hydraulic circuit 14*b* passages through the left port 12 of the helm pump 10 and enters the helm pump 10. The amount of liquid that enters the helm pump 10 is equal to the amount of the liquid that has been discharged.

When the steering wheel 13 is turned in a direction opposite to the above, the liquid flows in a direction opposite to the above thereby to achieve an effect opposite to that described above.

In the manual steering apparatus using the helm pump 10, a proportional relationship is maintained between the rotating angle of the steering wheel 13 and the moving distance of the piston rod 22, so that the rotating angle of the steering wheel 13 and the position of the rudder 27 have a particular relation with each other. As a result, the rudder can be steered by turning the steering wheel 13 over a certain angle thereby to turn the rudder 27 to a required angle.

In the case described above, the rudder 27 is caused to move at a speed proportional to the rotating speed of the steering wheel 13.

However, the manual steering apparatus requires it to rotate the steering wheel 13 manually against the resistance of the rudder 27. This is not a problem in a small vessel where the rudder 27 poses a relatively small resistive force, although a significant magnitude of force is required to operate the steering wheel 13 in a large vessel where the rudder 27 poses a large resistive force.

(2) A Power-Assisted Steering Apparatus of the Prior Art Using a Metering Device For the purpose of solving the problem of the manual steering apparatus described above, power-assisted steering apparatuses have been provided that reduce the amount of force required when steering. A latest example of the power-assisted steering apparatus will be described below with reference to FIG. 29 through FIG. 31.

FIG. 29 shows a rotary switching valve 130 placed at a neutral position (a position where the rudder is not effective). FIG. 30 shows the rotary switching valve 130 shifted to the left so that a piston rod 22 is moved to the right by hydraulic pressure. FIG. 31 shows the rotary switching valve 130 shifted to the right so that a piston rod 22 is moved to the left by hydraulic pressure. In the description that follows, the rudder 27 linked to the piston rod 22 is omitted.

The power-assisted steering apparatus comprises a mechanism that consists of a metering device 100, a hydraulic pump 120 that supplies the liquid and has a tank 110 for holding returned excess liquid, etc.

While making reference to FIG. 30, too, operation and construction of the apparatus will be described below.

When the steering wheel 103 is turned away from the neutral position in one direction, a rotary switching valve 130 that is mechanically linked with the steering wheel 103 so as to operate as the steering wheel 103 rotates moves from the state shown in FIG. 29 to the left into the state shown in FIG. 30. Under this condition, a pressure switch 123 is turned on by an increasing pressure of the liquid discharged from the metering pump 100, so that a pump motor 121 that is mechanically linked with the hydraulic pump 120 is started to run. The liquid discharged from a lower port 120*b* of the hydraulic pump 120 flows through a port 132*b* and a port 132*c* of a rotary switching valve right chamber 132 and enters a right-hand port 101 of the metering device 100. The amount of liquid that enters is limited to the measured quantity that is determined by the rotating speed of the steering wheel 103. Excess of the liquid passes through a right-hand bypass passage 132*g* provided in the rotary switching valve 130 and returns to the tank 110 via a port 132*a* of the rotary switching valve right chamber 132. The liquid introduced into the metering device 100 is discharged through the left-hand port 102 of the metering device to be circulated through a port 132*d* and a port 132*f* of the rotary switching valve right chamber 132 of the rotary switching valve 130 and the left-hand port 24 of the cylinder 20 thereby to enter the left-hand chamber 25 of the cylinder so as to drive the piston 21 and the piston rod 22. The liquid emerging from the cylinder right-hand chamber 25 passes through a port 132*e* and then a port 132*a* of the rotary switching valve right chamber 132 of the rotary switching valve 130 thereby to return to the tank 110.

In case the steering wheel 103 is turned in a direction opposite to that described above, the liquid passes through the circuit as shown in FIG. 31, so that the piston 21 and the piston rod 22 move in a direction opposite to that described above.

In the power-assisted steering apparatus of the prior art described above, the pump motor 121 rotates at a constant speed so that the hydraulic pump 120 always discharges the maximum flow rate required by the rudder 27. In case the flow rate required by the cylinder 20 is less than the maximum flow rate, excess of the liquid is all returned to the tank 110 through the right-hand bypass passage 132*g* or the left-hand bypass passage 133*g* of the rotary switching valve 130.

Therefore, the power-assisted steering apparatus of the prior art described above reduces the force required of the steersman, although the hydraulic pump 120 continues to supply the liquid unnecessarily most of the time, resulting in a significant waste of energy. It has also such a drawback as the steersman cannot get the feel of moving the rudder 27 against external force.

An object of the present invention is to provide a power-assisted steering apparatus that gets rid of the drawbacks of the power-assisted steering apparatus of the prior art described above, allows the steersman to easily operate the steering wheel and saves energy consumption with minimized waste of energy.

Another object of the present invention is to provide a power-assisted steering apparatus of better steerability that lets the steersman feel the resistive force exerted on the steering wheel from the outside as in the case of the manual steering apparatus.

DISCLOSURE OF THE INVENTION

In order to achieve objects described above, the steering apparatus of the present invention employs a hydraulic pump, used to reduce the force required for steering, that discharges the same amount of liquid which is discharged from a helm pump, without discharging excess liquid as in the case of the hydraulic pump used in the power-assisted steering apparatus of the prior art described above. That is, entire hydraulic circuit of the apparatus is constructed in a fully closed circuit, where the liquid of the same discharging flow rate as that of the helm pump 10 is drawn so as to increase the pressure, thereby to move the steering wheel with a cylinder driven by the increased pressure.

Since the discharging flow rate of the helm pump 10 depends on the rotating speed of the helm pump that is related to the operation of the steering wheel, a variable speed motor is used to drive the hydraulic pump of the present invention in order to accommodate changes in the liquid flow rate (a constant speed motor is used in the prior art). Specifically, either voltage or frequency of the power supply to a motor drive circuit is changed to change the motor speed.

In the apparatus of the present invention, the motor that drives the hydraulic pump is controlled by means of the resistive pressure acting on the helm pump during rotation of the helm pump 10, for example a value that is related (by proportional or other relation) to the pressure difference between the discharge side and suction side of the helm pump. The resistive force corresponds to the force (torque) required to rotate the helm pump. This means that the hydraulic pump motor is controlled in accordance to the torque of the rotating helm pump.

According to the present invention, therefore, when the steering wheel is not being operated and the helm pump it not rotating accordingly, the hydraulic pump is not driven to run, too. The hydraulic pump is driven to run only when the helm pump rotates due to the operation of the steering wheel.

Moreover, since the hydraulic pump is controlled by means of the resistive pressure generated during rotation of the helm pump (equivalent to the torque required to rotate the helm pump), energy consumption can be significantly reduced compared to the hydraulic pumping means employed in the power-assisted steering apparatus of the prior art that always causes the liquid to flow with a capacity greater than required.

Also according to the present invention, resistive force from the outside can be transmitted from the rudder via the hydraulic circuit or the helm pump to the steering wheel, so that the steersman can get the feeling of manual steering. Such a feeling of manual steering can never be experienced with the power-assisted steering apparatus of the prior art.

The steering apparatus of the present invention that is based on the basic concept and operation described above has the following features.

The steering apparatus of the present invention has the first feature that the steering apparatus comprises a steering wheel 13 and a helm pump 10 that can be rotated in both the forward and reverse directions by operating said steering wheel 13 and discharges a liquid of a quantity proportional to the rotating angle provided as steering means on the steersman side, and double action cylinder means consisting of a cylinder 20, a piston 21 and a piston rod 22 provided on rudder 27 side of the ship as means for moving the rudder 27, with the steering means and the double action cylinder means being connected with each other by means of a hydraulic circuit, so that the entire liquid that is discharged from the helm pump 10 is introduced via the hydraulic circuit into one chamber of the cylinder 20 of the double action cylinder means and the same amount of liquid is discharged from the other chamber of the cylinder 20 so as to flow through the hydraulic circuit into the helm pump 10, thus constituting the hydraulic circuit having fully closed circuit construction as a whole and moving the rudder 27 by an amount corresponding to the amount of liquid introduced into said cylinder 20, wherein pump means that generates the discharging pressure in the same direction as the discharging direction from the helm pump 10 against the resistive pressure from the oil hydraulic circuit generated during rotation of the helm pump 10 due to the operation of said steering wheel 13 is installed in series in part of the fully closed hydraulic circuit, so that the steering resistance of the steering wheel 13 is automatically reduced by means of the assistance of said pump means.

According to the first feature described above, when the helm pump 10 is caused to rotate in one direction, forward or reverse, by the operation of the steering wheel 13 and the liquid is discharged by the helm pump 10 into the hydraulic circuit, resistive pressure from the hydraulic circuit is generated by rotation of the helm pump 10. Thus the operation of the steering wheel 13 becomes difficult when the resistive pressure of the liquid increases (this is the case of the manual steering apparatus of the prior art). According to the first feature described above, since such a constitution is employed as the pressure is generated in the same direction as the discharging direction of the helm pump 10 with the discharging pressure corresponding to the resistive pressure exerted by the pumping means installed in series in the hydraulic circuit according to the rotation of the helm pump 10, the steering resistance of the steering wheel 13 is reduced by the amount of liquid discharged by the pumping means so that steering operation becomes lighter and easier.

Since the apparatus having the first feature is constituted as the fully closed circuit as a whole, liquid of exactly the same quantity as discharged by the helm pump 10 into the hydraulic circuit is exactly introduced into the cylinder 20, thus making it possible to move the rudder 27 by an amount exactly corresponding to the amount of liquid discharged. That is, direction, speed and distance (rudder angle) of moving the rudder 27 can be exactly determined according to the direction, speed and angle of rotating the steering wheel 13.

Also because the apparatus is made in fully closed circuit construction as a whole, it is made possible to reflect the resistance to the operation of the steering wheel 13 to the resistive pressure of liquid generated in the hydraulic circuit, resistance against the steering operation can be reduced without loss of energy by generating the steering assisting pressure with the pumping means only during the period when the resistance against steering is generated and to the magnitude that corresponds to the resistance against steering.

Also in the apparatus having the first feature, the resistance which the steersman receives during the steering operation can represent, in addition to the rotating speed of the helm pump 10, the resistance against the movement of the rudder 27 exerted from the outside via the hydraulic circuit 14, and therefore the steersman can get the feeling of manual steering with the resistance against steering operation being reduced.

In addition to the constitution of the first feature described above, the steering apparatus of the present invention has a second feature that the hydraulic circuit 14 consists of a pair of hydraulic circuits 14*a*, 14*b* installed between and connecting the steering means and the double action cylinder. In such a constitution as the entire discharging flow rate of the helm pump 10 is introduced into one chamber of the cylinder 20 via one of the pair of hydraulic circuits 14*a*, 14*b* into the cylinder 20 and the same amount of liquid is discharged from the other chamber of the cylinder 20 to flow through the other one of the pair of hydraulic circuits 14*a*, 14*b* into the helm pump 10, the hydraulic circuit 14 consisting of the fully closed circuit as a whole is formed and the rudder 27 is moved over a distance that corresponds to the amount of liquid introduced into the cylinder 20.

At least a hydraulic pump 30 capable of discharging in both ways is provided as the pump means, the hydraulic pump 30 capable of discharging in both ways being installed in series in the hydraulic circuit 14*b* of the hydraulic circuit 14 that has the fully closed circuit construction, wherein a discharging pressure is applied in the same direction as the discharging direction of the helm pump 10 by the pump means including the hydraulic pump 30 in accordance to the resistive pressure against the operation of the steering wheel 13, so that the steering resistance of the steering wheel 13, is automatically reduced.

According to the second feature described above, the discharging flow from the helm pump 10 due to the operation of the steering wheel 13 passes through one of the pair of hydraulic circuits 14*a*, 14*b* of the hydraulic circuit 14 consisting of the fully closed circuit so that the liquid of the same amount as that discharged enters one of the chambers of the cylinder 20, thereby to push the piston 21 and move the rudder 27. Accordingly, the same amount of liquid is discharged from the other chamber of the cylinder 20 to pass the other passage of the pair of hydraulic circuits 14*a*, 14*b* and enters the helm pump 10. Meanwhile the hydraulic pump capable of discharging in both ways is provided as the pump means and is installed in series in one of the hydraulic circuits 14*a*, 14*b*.

When a resistive pressure against the discharge pressure of the helm pump 10 is generated by operating the steering wheel 13 to rotate the helm pump 10 in either direction, the hydraulic pump 30 capable of discharging in both ways is driven to discharge the liquid at a discharging pressure corresponding to the resistive pressure in the same direction as the discharging direction of the helm pump 10. This reduces the resistance exerted on the steering wheel 13 by the amount corresponding to the liquid discharged by the pump means, thus making the steering operation easier.

Since the hydraulic pump can discharge the liquid in both ways, operation of the steering wheel 13 in both ways can be facilitated by a single pump. Since the entire apparatus is made in the fully closed circuit construction similarly to the case of the first feature, the rudder 27 can be moved by the amount that exactly corresponds to the discharging flow rate of the helm pump 10 and a resistive pressure that exactly represents the rotation and other conditions of the helm pump 10 caused by the operation of the steering wheel can be obtained. As a result, the pump means is required only to generate the minimum necessary discharging pressure. Also because the pump means is driven only during the period when the steering wheel is operated and the helm pump 10 is rotating, thus energy saving operation can be achieved.

Also the resistance which the steersman receives when operating the steering wheel 13 can represent, in addition to the rotating speed of the helm pump 10, the resistance against the movement of the rudder 27 exerted from the outside via the hydraulic circuit 14, and therefore the steersman can get the feeling of manual steering with the resistance against steering operation being reduced.

In the steering apparatus of the present invention having the constitution depicted in the second feature described above, the pump means that generates the pressure of the liquid in the same direction as the discharging direction of the helm pump 10 has a pressure detector that detects the resistive pressure generated by the rotation of the helm pump 10, and the motor drive circuit 41 of the hydraulic pump 30 is controlled so as to generate the discharging pressure that corresponds to the resistive pressure detected by the pressure detector, as the third feature.

According to the third feature, in addition to the operation and effect of the second feature, when the resistive pressure is generated against the discharge pressure of the helm pump 10 in response to the operation of the steering wheel 13, the pressure detector of the pump means detects the resistive pressure. Then the motor drive circuit of the hydraulic pump 30 is controlled in accordance to the resistive pressure detected by the pressure detector. Accordingly, the hydraulic pump 30 is driven to run with a discharge pressure corresponding to the direction and magnitude of the resistive pressure, and therefore the resistance acting on the steering wheel 13 is reduced.

According to the third feature, the steering wheel can be operated lightly and easily by controlling the hydraulic pump 30 in accordance to the resistive pressure generated by the rotation of the helm pump 10.

Other effects including the energy saving and the feeling of manual steering operation are achieved similarly to the case of the second feature.

The steering apparatus of the present invention of fourth feature has the constitution of the second feature wherein the pump means that generates the discharging pressure in the same direction as the discharging direction of the helm pump 10 has a pressure detector that detects the resistive pressure generated by the rotation of the helm pump 10 and a current detector that detects the motor current of the hydraulic pump 30, so that the resistive pressure detected by the pressure detector and the actual discharging pressure of the hydraulic pump 30 detected by the current detector are compared and the motor drive circuit 41 of the hydraulic pump 30 is controlled according to the difference.

According to the fourth feature, in addition to the operation and effect of the second feature, resistive pressure generated by rotation of the helm pump 10 is detected by the pressure detector of the pump means and the motor current of the hydraulic pump 30 during operation is detected by the current detector during operation of the steering wheel 13. Since the motor current of the hydraulic pump 30 during operation corresponds to the actual discharging pressure of the hydraulic pump 30, the value detected by the pressure detecting means and the value detected by the current detecting means can be easily compared to each other by converting the values to equivalents of the same unit. That is, the resistive pressure acting against the operation of the steering wheel 13 and the actual discharging pressure of the hydraulic pump 30 are compared so that the motor drive circuit 41 of the hydraulic pump 30 is controlled according to the difference of these values. Thus the discharging pressure of the hydraulic pump 30 is quickly corrected to a proper value so as to quickly reduce the resistive pressure acting against the operation of the steering wheel 13 and stabilization can be achieved quickly. The control according to the difference makes it possible to adjust the degree of assistance to the steering to suit the preference of the steersman.

According to the fourth feature, since the resistance against the steering operation is controlled according to the difference between the resistive pressure acting against the rotation of the helm pump 10 and the actual discharging pressure of the hydraulic pump 30, the resistive pressure against the steering operation can be reduced more quickly and stabilized at the reduced level.

Other effects including the energy saving and the feeling of manual steering operation are achieved similarly to the case of the second feature.

The steering apparatus of the present invention of fifth feature has such a constitution, in addition to the constitution of the first feature, as the hydraulic circuit 14 consists of a pair of hydraulic circuits 14*a*, 14*b* installed between and connecting the steering means and the double action cylinder means so that the entire liquid discharged from the helm pump 10 is introduced into one of the chambers of the cylinder 20 via one of the pair of hydraulic circuits 14*a*, 14*b* and the same amount of liquid is discharged from the other chamber of the cylinder 20 to flow through the other one of the pair of hydraulic circuits 14*a*, 14*b* into the helm pump 10, with the hydraulic circuit 14 being made in the construction of the fully closed circuit as a whole and the rudder 27 is moved over a distance that corresponds to the amount of liquid introduced into the cylinder 20.

At least a pair of hydraulic pumps 30, 31 capable of discharging in both ways are provided as the pump means, the pair of hydraulic pumps 30, 31 capable of discharging in both ways being installed in series in the hydraulic circuits 14*a*, 14*b*, respectively, of the hydraulic circuit 14 that is formed in the fully closed circuit, so that discharging pressure is applied in the same direction as the discharging direction of the helm pump 10 by the pump means that includes the pair of hydraulic pumps 30, 31 in accordance to the resistive pressure acting against the operation of the steering wheel 13, so that the steering resistance of the steering wheel 13 is automatically reduced.

According to the fifth feature described above, the liquid discharged from the helm pump 10 due to the operation of the steering wheel 13 passes through one of the pair of hydraulic circuits 14*a*, 14*b* of the hydraulic circuit 14 that has the fully closed circuit construction so that the liquid of the same amount as that discharged enters one of the chambers of the cylinder 20, thereby to push the piston 21 and move the rudder 27. Accordingly, the same amount of liquid is discharged from the other chamber of the cylinder 20 to pass through the other liquid passage of the pair of hydraulic circuits 14*a*, 14*b* and enters the helm pump 10.

Meanwhile a pair of hydraulic pumps capable of discharging in both ways are provided as the pump means and are installed in series in the hydraulic circuits 14*a*, 14*b*, respectively.

When a resistive pressure against the discharge pressure of the helm pump 10 is generated by operating the steering wheel 13 to turn the helm pump 10 in either direction, the pair of hydraulic pumps 30, 31 capable of discharging in both ways are driven to discharge the liquid in the same direction as the discharging direction of the helm pump at a discharging pressure that corresponds to the resistive pressure. This reduces the resistance exerted on the steering wheel 13 by the amount corresponding to the liquid discharged by the pump means, thus making the steering operation easier.

Since the hydraulic pumps 30, 31 are capable of discharging in both directions, operation of the steering wheel 13 in both ways can be facilitated by each of the pumps. Use of the pair of the hydraulic pumps 30, 31, in particular, reduces the required output of by each of the pumps 30, 31 to a half of the total output required, thus reducing the load on the pumps 30, 31. Use of the pair of the hydraulic pumps also makes the transfer of the liquid between the pair of hydraulic circuits 14*a*, 14*b* more uniform and stabilized.

Also in the event of a failure of one of the hydraulic pumps, the operation can be continued with the remaining pump that works.

Similarly to the case of the first feature, since it is required to drive the pumps 30, 31 only during the period when the steering wheel 13 is operated and resistance is generated against the steering operation, with an output that corresponds to the resistance against steering, energy saving operation can be achieved. Moreover the steersman can get the feeling of manual steering with the resistance against steering operation being reduced.

According to the sixth feature of the steering apparatus of the present invention, in addition to the constitution of the fifth feature, the pump means that generates the discharging pressure in the same direction as the discharging direction of the helm pump 10 has a pressure detector that detects the resistive pressure generated by rotation of the helm pump 10, while the motor drive circuit 41 that drives the pair of hydraulic pumps 30, 31 in common is controlled so as to generate a discharge pressure that corresponds to the resistive pressure of the liquid detected by the pressure detector.

According to the sixth feature, the steering wheel can be operated lightly and easily by controlling the hydraulic pumps 30, 31 in accordance to the resistive pressure generated by rotation of the helm pump 10.

Other effects including the energy saving and the feeling of manual steering operation are achieved similarly to the case of the fifth feature.

The steering apparatus of the present invention of seventh feature has the constitution of the fifth feature wherein the pump means that generates discharging pressure in the same direction as the discharging direction of the helm pump 10 has a pressure detector that detects the resistive pressure generated by rotation of the helm pump 10 and a current detector that detects the motor currents of the pair of hydraulic pumps 30, 31 so that the resistive pressure detected by the pressure detector and the actual discharging pressure of the hydraulic pumps 30, 31 detected by the current detector are compared so as to control the motor drive circuit 41 of the pair of hydraulic pumps 30, 31 according to the difference.

According to the seventh feature, in addition to the operation and effect of the fifth feature, that the resistive pressure detected by the pressure detector and the actual discharging pressure of the hydraulic pumps 30, 31 detected by the current detector are compared so as to control the motor drive circuit 41 of the pair of hydraulic pumps 30, 31 in accordance to the difference. Thus the discharging pressures of the hydraulic pumps 30, 31 are quickly corrected to a proper values so as to reduce the resistive pressure acting against the operation of the steering wheel 13 and achieve stabilization quickly.

According to the seventh feature, since the resistive pressure against the steering operation is controlled to increase or decrease according to the difference between the resistive pressure generated by rotation of the helm pump 10 and the actual discharging pressure of the hydraulic pumps 30, 31, it is made possible to decrease the resistive pressure against the steering operation more quickly and stabilized at the reduced level.

Other effects including the energy saving and the feeling of manual steering operation are achieved similarly to the case of the fifth feature.

The steering apparatus of the present invention of eighth feature has the constitution of the first feature wherein at least a hydraulic pump 32 capable of discharging only in one direction is provided as the pump means with the hydraulic pump 32 being installed in series in part of the hydraulic circuit 15 that has the construction of the fully closed circuit, and passage switching means is installed between the hydraulic pump 32 and the helm pump 10 so as to switch the passage amid said hydraulic circuit 15 according to the direction of discharging the liquid from the helm pump 10 and direct the liquid discharged by the helm pump 10 into a suction port of the hydraulic pump 32 regardless of the direction in which the helm pump discharges the liquid, so that discharging pressure is applied in the same direction as the discharging direction of the liquid from the helm pump 10, by means of the pump means that includes the hydraulic pump 32 and the passage switching means in accordance to the resistive pressure against the operation of the steering wheel 13, thereby to reduce the resistive pressure against the operation of the steering wheel 13 automatically.

According to the eighth feature, in addition to the operation and effect of the first feature, when the liquid is discharged from the helm pump 10 in either direction, forward or reverse, by the operation of the steering wheel 13, the passage switching means works in accordance to the direction in which the liquid is discharged from the helm pump 10 and switches the passage of the hydraulic circuit 15 so that the liquid discharged from the helm pump 10 flows into the suction port of the hydraulic pump 32. Therefore, the liquid always flows through the passage switching means installed in the hydraulic circuit 15 into the suction port of the hydraulic pump 32, regardless of the direction in which the liquid is discharged from the helm pump 10. The liquid is further discharged and enters one chamber of the cylinder 20 via the hydraulic circuit 15. As the piston 21 moves, the same amount of liquid is discharged from the other chamber of the cylinder 20 and enters the suction port of the helm pump 10 via the hydraulic circuit 15. Thus use of the passage switching means allows it to use the hydraulic pump 32 capable of discharging only in one direction as the hydraulic pump. Therefore, not only the less expensive hydraulic pump can be used, control mechanism of the pump means can also be made simpler and less expensive.

The energy saving effect and the effect of giving the feeling of manual steering operation can be achieved similarly to the case of the first feature.

According to the ninth feature of the steering apparatus of the present invention, in addition to the constitution of the eighth feature, the pump means that generates the discharging pressure in the same direction as the discharging direction of the helm pump 10 has a pressure detector that detects the resistive pressure generated by rotation of the helm pump 10, while the motor drive circuit 41 that drives the hydraulic pump 32 is controlled so as to generate a discharge pressure that corresponds to the resistive pressure of the liquid detected by the pressure detector.

According to the ninth feature, in addition to the operation and effect of the eighth feature and similarly to the operation and effect of the third and sixth features, the steering wheel can be operated lightly and easily by controlling the hydraulic pump 32 in accordance to the resistive pressure generated by rotation of the helm pump 10.

The steering apparatus of the present invention of tenth feature has the constitution of the eighth feature wherein the pump means, that generates the discharging pressure in the same direction as the discharging direction of the helm pump 10, has a pressure detector that detects the resistive pressure generated by rotation of the helm pump 10 and a current detector that detects the motor current of the hydraulic pump 32, so that the resistive pressure detected by the pressure detector and the actual discharging pressure of the hydraulic pump 32 detected by the current detector are compared and a motor drive circuit 41 of the hydraulic pump 32 is controlled according to the difference.

According to the tenth feature, in addition to the operation and effect of the eighth feature and similarly to the operation and effect of the fourth and seventh features, since the resistive pressure against the steering operation is controlled to increase or decrease according to the difference between the resistive pressure generated by rotation of the helm pump 10 and the actual discharging pressure of the hydraulic pumps 30, 31, it is made possible to decrease the resistance against the steering operation more quickly and stabilized at the reduced level.

The steering apparatus of the present invention of eleventh feature has, in addition to the constitution of the first feature, such a constitution having the hydraulic circuit 14 that consists of a pair of hydraulic circuits 14*a*, 14*b* installed between and connecting the steering means and the double action cylinder wherein the entire discharging flow rate of the helm pump 10 is introduced into one of the chambers of the cylinder 20 via one of the pair of hydraulic circuits 14*a*, 14*b* and the same amount of liquid is discharged from the other chamber of the cylinder 20 to flow through the other one of the pair of hydraulic circuits 14*a*, 14*b* into the helm pump 10, with the hydraulic circuit 14 being made in the construction of the fully closed circuit as a whole and the rudder 27 is moved over a distance that corresponds to the amount of liquid introduced into the cylinder 20.

At least the hydraulic pump 32 capable of discharging only in one direction is provided and is installed in series in the pair of hydraulic circuits 14*a*, 14*b* of the hydraulic circuit 14 that is formed in the fully closed circuit construction, and a pair of passage switching means is installed between the hydraulic pump 32 and the helm pump 10 and between the hydraulic pump 32 and the cylinder 20 so as to switch the passage amid the hydraulic circuit 14 according to the direction of discharging the liquid from the helm pump 10 thereby to connect the liquid from the helm pump 10 to the suction side of said hydraulic pump 32 regardless of which direction said helm pump 10 discharges, so that discharging pressure is applied in the same discharging direction from the helm pump 10, by means of the pump means that includes the hydraulic pump 32 and the passage switching means in accordance to the resistive pressure against the operation of the steering wheel 13, thereby to reduce the resistive pressure against the operation of the steering wheel 13 automatically.

According to the eleventh feature described above, in addition to the operation and effect of the second feature, use of the pair of passage switching means makes it possible to make the construction of the hydraulic circuit 14 simpler than in the case of the twelfth feature where only one passage switching means is provided, and the passage switching means itself can be of a simple construction thus allowing it to use an inexpensive switching valve available in the market.

The twelfth feature of the steering apparatus of the present invention has the constitution of the eleventh feature described above wherein the pump means, that generates the discharging pressure in the same discharging direction from the helm pump 10, has a pressure detector that detects the resistive pressure generated by rotation of the helm pump 10, so that the motor drive circuit 41 that drives the hydraulic pump 32 is controlled so as to generate discharge pressure that corresponds to the resistive pressure of the liquid detected by the pressure detector.

According to the twelfth feature, in addition to the operation and effect of the eleventh feature, operation and effect similar to those of the third, sixth and ninth features can be achieved.

The steering apparatus of the present invention of thirteenth feature has the constitution of the eleventh feature wherein the pump means, that generates the discharging pressure in the same discharging direction from the helm pump 10, has a pressure detector that detects the resistive pressure generated by rotation of the helm pump 10 and a current detector that detects the motor current of the hydraulic pump 32, so that the resistive pressure detected by the pressure detector and the actual discharging pressure of the hydraulic pump 32 detected by the current detector are compared and the motor drive circuit 41 of the hydraulic pump 32 is controlled according to the difference of these values.

According to the thirteenth feature, in addition to the operation and effect of the eleventh feature, operation and effect similar to those of the fourth, seventh and tenth features can be achieved.

The steering apparatus of the present invention of fourteenth feature has, in addition to the constitution of the first feature, such a constitution having the hydraulic circuit 14 that consists of a pair of hydraulic circuits 14*a*, 14*b* installed between and connecting the steering means and the double action cylinder wherein the entire discharging flow rate of the helm pump 10 is introduced into one of the chambers of the cylinder 20 via one of the pair of hydraulic circuits 14*a*, 14*b* and the same amount of liquid is discharged from the other chamber of the cylinder 20 to flow through the other one of the pair of hydraulic circuits 14*a*, 14*b* into the helm pump 10, with the hydraulic circuit 14 being made in the construction of the fully closed circuit as a whole and the rudder 27 is moved over a distance that corresponds to the amount of liquid introduced into the cylinder 20.

At least a pair of hydraulic pumps 33, 34 capable of discharging only in one direction are provided as the pump means and are installed in series in the pair of hydraulic circuits 14*a*, 14*b* of the hydraulic circuit 14 that is formed in the fully closed circuit construction, so that either one of the pair of hydraulic pumps 33, 34 capable of discharging only in one direction is driven according to the direction of liquid discharged from the helm pump 10 by the operation of the steering wheel 13, and discharging pressure is applied in the same discharging direction from the helm pump 10 in correspondence to the resistive pressure generated by the rotation of the helm pump 10 thereby to automatically reduce the steering resistance of the steering wheel 13.

According to the fourteenth feature described above, in addition to the operation and effect of the second feature, cost reduction can be achieved since the hydraulic pump 32 capable of discharging only in one direction can be used as the hydraulic pump, although the hydraulic circuit and control of the pump become somewhat complicated in comparison to the case of the fifth feature that uses a pair of hydraulic pump 30 capable of discharging in both ways. The combination of the hydraulic pump 32 capable of discharging only in one direction and bypassing the pump provides an advantage of being capable of easily adding manual steering function that is useful in the event of pump failure.

The fifteenth feature of the steering apparatus of the present invention has the constitution of the fourteenth feature described above wherein the pump means, that generates the discharging pressure in the same discharging direction from the helm pump 10, has a pressure detector that detects the resistive pressure generated by rotation of the helm pump 10, while the motor drive circuit 41 that drives the hydraulic pumps 33, 34 is controlled so as to generate discharge pressure that corresponds to the resistive pressure of the liquid detected by the pressure detector.

According to the fifteenth feature, in addition to the operation and effect of the fourteenth feature, operation and effect similar to those of the third, sixth and ninth features can be achieved.

The steering apparatus of the present invention of sixteenth feature has the constitution of the fourteenth feature wherein the pump means, that generates the discharging pressure in the same discharging direction from the helm pump 10, has a pressure detector that detects the resistive pressure generated by rotation of the helm pump 10 and a current detector that detects the motor current of the hydraulic pumps 33, 34, so that the resistive pressure detected by the pressure detector and the actual discharging pressures of the hydraulic pumps 33, 34 detected by the current detector are compared and the motor drive circuit 41 of the hydraulic pumps 33, 34 is controlled according to the difference.

According to the sixteenth feature, in addition to the operation and effect of the fourteenth feature, operation and effect similar to those of the fourth, seventh and tenth features can be achieved.

BRIEF DESCRIPTION OF THE DRAWINGS

FIG. 1 and FIG. 2 show schematic constitution of the steering apparatus according to first embodiment of the present invention. FIG. 3 and FIG. 4 show schematic constitution of the steering apparatus according to second embodiment of the present invention. FIG. 5 through FIG. 11 show schematic constitution of the steering apparatus according to third embodiment of the present invention. FIG. 12 and FIG. 18 show schematic constitution of the steering apparatus according to fourth embodiment of the present invention. FIG. 19 and FIG. 20 show schematic constitution of the steering apparatus according to fifth embodiment of the present invention. FIG. 21 through FIG. 27 are diagrams explanatory of the control of the apparatus of the present invention.

BEST MODE FOR CARRYING OUT THE INVENTION

Figure 1:
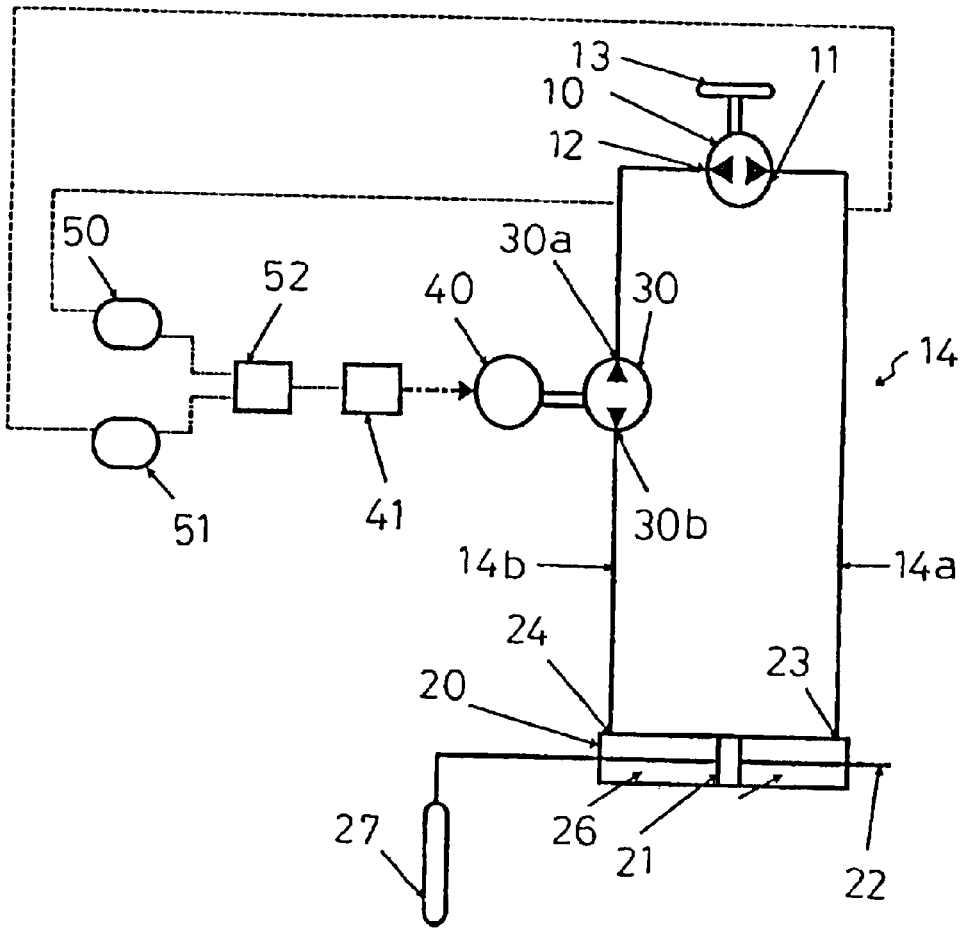
FIG. 1 through FIG. 20 show preferable steering apparatuses according to the present invention.

An example of preferable steering apparatuses according to the present invention will be described below with reference to FIG. 1 and FIG. 2. The constitution shown in FIG. 1 and FIG. 2 correspond to the second through fifth features.

Installed on the steersman side of the steering apparatus is a steering wheel 13 used as steering means and a helm pump 10. The helm pump 10 is a pump that can be rotated either in forward or reverse direction and discharges a liquid of a quantity proportional to the rotating angle. Specifically, the helm pump rotates in forward or reverse direction according to the operation of the steering wheel 13, so as to discharge the liquid in exact quantity that is proportional to the angle of rotation. When the steering wheel 13 is turned clockwise, for example, the helm pump 10 rotates clockwise by an angle that corresponds to the rotating angle of the steering wheel 13, and discharges a quantity of the liquid proportional to the angle of rotation of the helm pump 10 in the direction corresponding to the clockwise rotation.

Installed on the rudder 27 side of the ship is double action cylinder means for moving the rudder 27. The double action cylinder means comprises a cylinder 20 that can move a piston in both ways, a piston 21 and a piston rod 22, wherein the rudder 27 is moved in linkage with the movement of the piston rod 21.

The steering means comprising the steering wheel 13 and the helm pump 10 and the cylinder 20 of the double action cylinder means are connected with a hydraulic circuit. The hydraulic circuit is constituted in a fully closed circuit as a whole. That is, the liquid contained in the hydraulic circuit does not flow out of the hydraulic circuit, and any liquid outside of the hydraulic circuit does not enter inside.

The hydraulic circuit includes pump means installed in series in a part thereof. The pump means generates the discharging pressure in the same discharging direction from the helm pump 10 in correspondence to the resistive pressure generated by rotation of the helm pump 10, and has the function to reduce the resistive pressure against the rotation of the helm pump 10, namely resistance against steering operation.

The hydraulic circuit in this embodiment is constituted of a hydraulic circuit 14 formed in the fully closed circuit that has a pair of hydraulic circuits 14*a*, 14*b*. As used herein, the term "hydraulic circuit" exclusively refers to an oil hydraulic circuit and the term "liquids" refers to oil. The hydraulic circuit uses, for example, rubber as the piping material so as to be flexible enough to facilitate the installation on a ship.

A hydraulic pump 30 capable of discharging in both ways 30 is provided as the pump means, with the hydraulic pump 30 being installed in series in either one of the pair of hydraulic circuits 14*a*, 14*b* (14*b* in this embodiment).

The hydraulic pump 30 is combined with a pump motor 40 that drives the hydraulic pump and a motor drive circuit 41 that controls the pump motor.

The pump motor 40 that drives the hydraulic pump 30 may be a direct current motor, but also may be a 3-phase induction motor. When a direct current motor is used, the motor current and the discharging pressure of the pump (motor shaft torque) are in proportional relationship with each other. In the case of a 3-phase induction motor, there is also a substantially proportional relationship between motor current and the motor shaft torque (discharging pressure of pump). It is critical to use the pump motor 40 of such a type that allows it to relate the motor current to the discharging pressure of the pump.

The pump means also has a pressure detector for detecting the resistive pressure generated by rotation of the helm pump 10 as the helm pump 10 rotates.

The pressure detector in this embodiment comprises a pair of pressure detectors 50, 51 that detect the pressures at locations before and after the helm pump 10. The resistive pressure generated by rotation of the helm pump 10 can be determined by finding the difference between the pressures detected by the detectors 50, 51 by means of a pressure subtraction circuit 52.

When the helm pump 10 rotates counterclockwise as the steering wheel 13 is turned counterclockwise, for example, the liquid of a quantity that corresponds to the angle of rotation is continuously discharged from the left-hand port 12 of the helm pump 10 into the hydraulic circuit 14*b*. The entire liquid that is discharged is forced through the hydraulic pump 30 and the left-hand port 24 of the cylinder into the left chamber 26 of the cylinder, thereby to move the piston 21 to the right over a distance that corresponds to the quantity of liquid discharged. At the same time, the same amount of liquid is discharged from the right chamber 25 of the cylinder to flow through the right port 23 of the cylinder into the hydraulic circuit 14*a* after which the liquid is set through the right port 11 of the helm pump into the helm pump 10. This means that the discharging flow rate of the helm pump 10 is used in the cylinder 20 to move the rudder 27, while the same amount of liquid is drawn into the helm pump 10, resulting in no excess or shortage in the net quantity of the liquid. This is the implication of the fully closed circuit.

The resistive pressure acting against the rotation of the helm pump 10 that is generated by the helm pump 10 rotating in either forward or reverse direction changes constantly as the helm pump 10 rotates. The faster the steering wheel 13 is turned (the faster the helm pump 10 rotates), the more quickly the resistive pressure increases. The resistive pressure generated by rotation of the helm pump 10 also becomes higher when the resistance from the outside against the movement of the rudder 27 increases. The resistive pressure can be known by detecting the pressures near the left and right ports 11, 12 of the helm pump 10 by means of the pair of pressure detectors 50, 51. When the pressure detected by the left-hand pressure detector 50 minus the pressure detected by the right-hand pressure detector 51 is has a positive value, it is determined that the liquid is discharged from the left port 12 of the helm pump 10, in which case the pump motor 40 is set to rotate in such a direction as the hydraulic pump 30 discharges the liquid downward in the positional relationship shown in the drawing.

When the resistive pressure against the helm pump 10 is determined from the difference between the pressures detected by the pressure detectors 50, 51, the motor drive circuit 40 controls the motor 40 according to the resistive pressure that has been determined. This causes the pump 30 to generate a proper discharging pressure in accordance to the resistive pressure generated by rotation of the helm pump 10, thereby drawing the liquid from the helm pump 10 and forces it to the cylinder 20. As a result, the resistance against the helm pump 10 is reduced by the discharging pressure of the hydraulic pump 30, thereby making the operation of the steering wheel 13 lighter.

Provided that the relation between the discharging pressure of the hydraulic pump 30 and the current flowing in the motor 40 and the relation between the current flowing in the motor 40 and the drive voltage of the motor 40 (substantially proportional to the rotating speed of the motor) are known beforehand, the hydraulic pump can be controlled to discharge the liquid with a proper pressure by applying a corresponding voltage.

Steering operation can be assisted more delicately by applying the control to the hydraulic pump 30 at shorter time intervals.

In the pump means shown in FIG. 1, the motor 40 of the hydraulic pump 30 is controlled in accordance to the discharging pressure generated in the same direction as the discharging direction from the helm pump 10.

The resistive pressure generated by rotation of the helm pump 10 described above can be detected, for example, in the form of voltage at the pressure detectors 50, 51. In the meantime the discharging pressure of the hydraulic pump 30 can be related to the current flowing in the motor 40. Therefore, once the discharging pressure to be generated by the hydraulic pump 30 in accordance to the resistive pressure detected as the voltage is determined, the current that corresponds to the discharging pressure can be calculated. Then the hydraulic pump 30 can be caused to generate the required level of discharging pressure by supplying the calculated level of current from the motor drive circuit 41 to the pump motor 40.

The discharging pressure generated by the hydraulic pump 30 can be controlled to become equal to the resistive pressure generated at the helm pump 10. Accordingly, the same quantity of the liquid can be drawn into the hydraulic pump 30 and discharged to the cylinder 20 so as to follow the resistive pressure generated by rotation of the helm pump 10 that changes continuously.

In case a pump that blocks the hydraulic circuit 14*b* when not in operation, for example a blocking gear pump, is used as the hydraulic pump 30, the resistive pressure transmitted from the outside via the rudder 27, the cylinder 20 and the hydraulic circuit 14*a* is shut off at the hydraulic pump 30 till the hydraulic pump is started to run. Once the hydraulic pump 30 is put into operation and hydraulic circuit is established to act on the piston 21 of the cylinder 20, resistive pressure exerted from the outside against the movement of the rudder 27 acts against the discharging pressure of the hydraulic pump 30, and is further transmitted as the resistive pressure against the helm pump 10, eventually to be received by the operator of the steering wheel 13.

In case a blocking gear pump that blocks the hydraulic circuit 14*b* when not in operation is used as the hydraulic pump 30, the hydraulic circuit between the helm pump 10 and the hydraulic pump 30 is blocked in the initial state (resistive pressure exerted from the outside via the rudder 27 is shut off at the hydraulic pump 30 in this state). When the steering wheel 13 is operated in this state so that the liquid is discharged from the left port 12 of the helm pump 10, pressure in the blocked hydraulic circuit ahead of the left port 12 builds up as the resistive pressure. The pressure detectors 50, 51 detect this pressure and the hydraulic pump 30 is started to operate. After the hydraulic pump 30 has started to operate, resistive pressure from the outside is transmitted via the hydraulic pump 30 to the steering wheel 13 as the resistive pressure generated by rotation of the helm pump 10, thereby affecting the steering operation.

When the steering wheel 13 is turned clockwise, opposite to that described above, the liquid is discharged from the right port 11 of the helm pump 10. In this case, the pressure difference detected by the pressure detectors 50, 51 has a negative value, and therefore the pump motor 40 rotates in such a direction as the hydraulic pump 30 discharges the liquid upward, opposite to that described above, in the positional relationship shown in the drawing. Thus the liquid is discharged toward the suction port (left port 12) of the helm pump 10, so as to reduce the negative pressure generated at the suction port of the helm pump 10, thereby reducing the steering resistance of the steering wheel 13. Control by the pump means is the same as that described above, except that the motor 40 rotates in a direction opposite to that in the case of rotating the helm pump counterclockwise.

Figure 2:
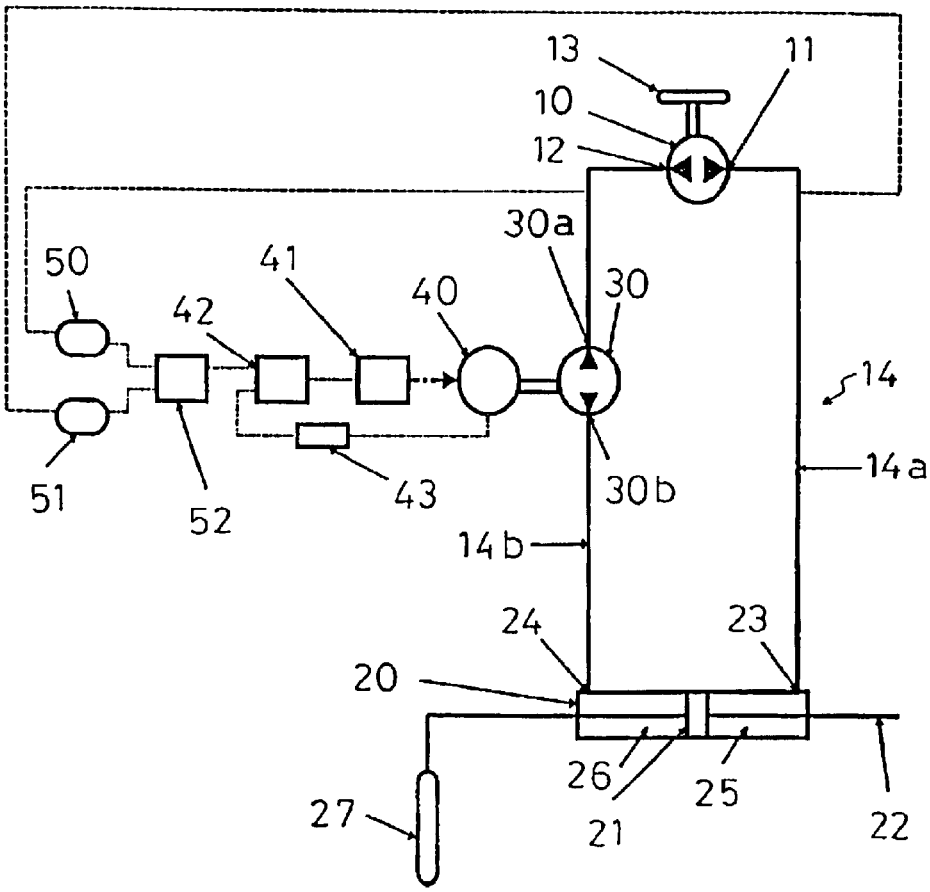

The pump means shown in FIG. 2 has, in addition to the hydraulic pump 30 capable of discharging in both ways 30, the pump motor 40, the motor drive circuit 41, the pair of pressure detectors 50, 51 and the pressure subtraction circuit 52, a motor current detector 43 that detects the current flowing in the pump motor 40 (that represents the driving torque of the motor 40) and a comparator circuit 42 that compares the current detected by the motor current detector 43 and the output of the pressure subtraction circuit 52 and sends an output that corresponds to the difference to the motor drive circuit 41.

This embodiment corresponds to the fourth feature of the present invention. The constitution is similar to the constitution described in conjunction with FIG. 1 with other regards.

The current detected by the motor current detector 43 is related to the torque of the pump motor 40, while the torque of the motor 40 is related to the actual discharging pressure of the hydraulic pump 30. The input value from the pressure subtraction circuit 52 to the comparator circuit 42 represents the resistive pressure which also represents the torque of rotating the helm pump 10. Therefore, the comparator circuit 42 can compare the input value from the pressure subtraction circuit 52 and the input value from the motor current detector 43 exactly as the values having the same unit of torque. Then the motor drive circuit 41 controls the pump motor 40 in accordance to the different of the two values that have been compared.

In the control operation described above, the control voltage applied to the hydraulic pump is changed according to the value of difference between the resistive pressure against the helm pump 10 (torque required to rotate the helm pump) and the actual discharging pressure of the hydraulic pump 30 (drive torque of the pump motor 40). Consequently, when the difference has a large value, the liquid discharged from the hydraulic pump can be increased or decreased quickly so as to reach a proper discharging state. Once a proper discharging pressure is attained, this state can be easily stabilized.

Another example of a preferable steering apparatus according to the present invention will be described below with reference to FIG. 3 and FIG. 4. The constitution shown in FIG. 3 and FIG. 4 corresponds to the sixth through ninth features.

Figure 3:
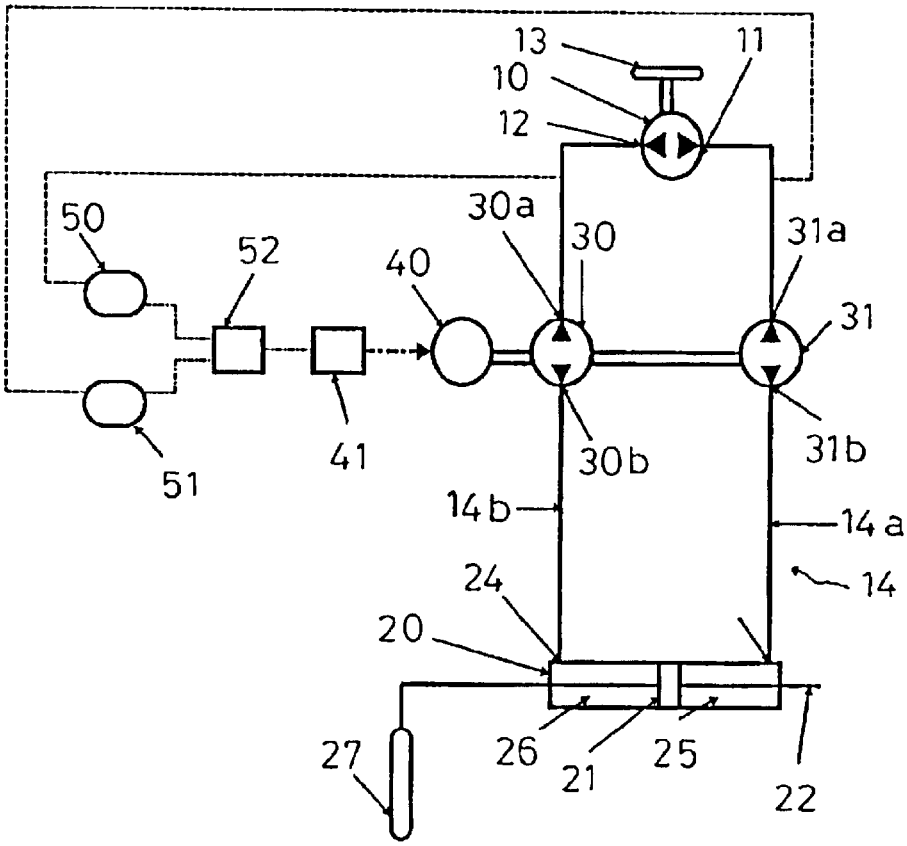

In contrast to the constitution shown in FIG. 1 that employs a single hydraulic pump 30, the apparatus shown in FIG. 3 is provided with a pair of hydraulic pumps 30, 31 capable of discharging in both ways as the pump means. And the pair of hydraulic pumps 30, 31 are provided with a common pump motor 40 and a common pump drive circuit 41. The pair of hydraulic pumps 30, 31 are made in such a constitution that, when one of the hydraulic pumps, 31, discharges the liquid downward (from the lower port 30*b*), the positional relationship show on the drawing, the other hydraulic pump 31 discharges the liquid upward (from the upper port 30*a*), while when one of the hydraulic pumps, 30, discharges the liquid from the upper port 30*a*, the other hydraulic pump 31 discharges the liquid from the lower port 31*b*. Thus the liquid flows in a fixed direction through the hydraulic circuit 14 regardless of which port, 11 or 12, the helm pump 10 discharges the liquid through.

The discharging pressures generated by the hydraulic pumps 30, 31 are assigned so as to sum up to the total pressure equal to the required discharging pressure. The partial pressures may be assigned as halves or in such proportions as the discharging pressure at the discharging side of the helm pump 10 is increased and the discharging pressure at the suction side of the helm pump 10 is decreased in accordance to the pressures generated at the discharging side and the suction side of the helm pump 10, the required discharging pressure is generated as the total.

In the apparatus shown in FIG. 3, the pump means is made in such a constitution as controlled by means of the pair of pressure detectors 50, 51 and the pressure subtraction circuit 52. The control operation is similar to that described in conjunction with the apparatus shown in FIG. 1.

Figure 4:
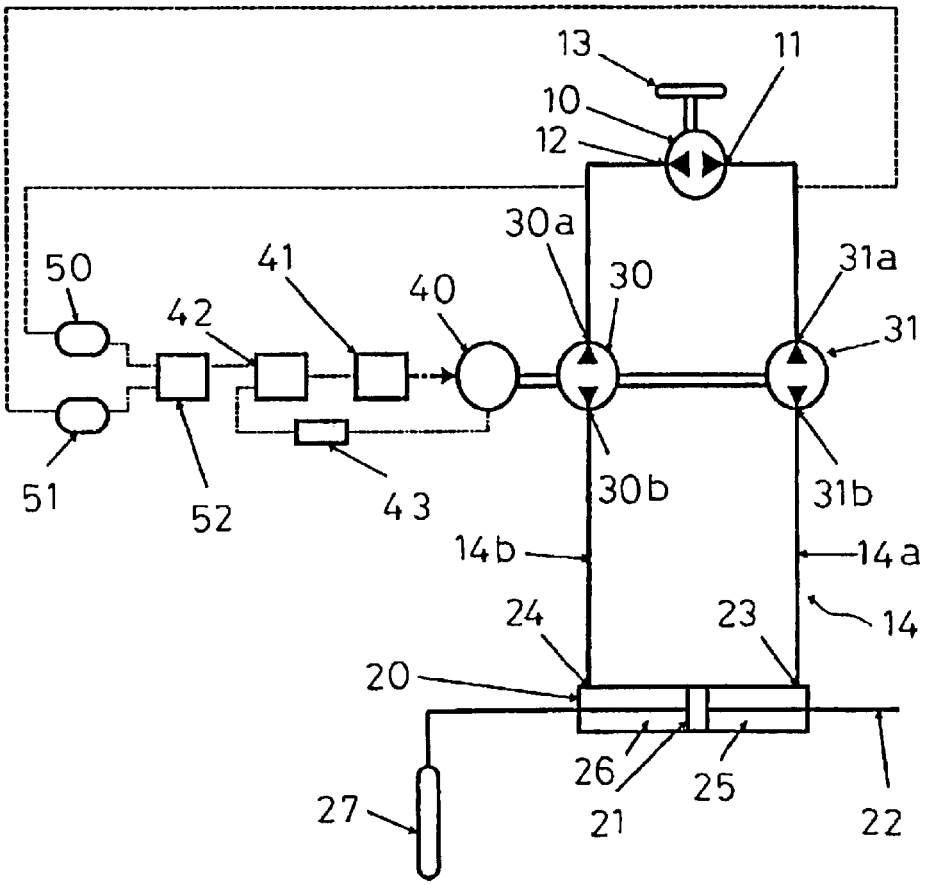

In the apparatus shown in FIG. 4, the pump means is made in such a constitution as controlled by means of the pair of pressure detectors 50, 51, the pressure subtraction circuit 52, the comparator circuit 42 and the motor current detector 43. The control operation is similar to that described in conjunction with the apparatus shown in FIG. 2. It is the same as the apparatus shown in FIG. 3 that the required discharging pressure is divided and assigned to the pair of hydraulic pumps 30, 31.

In the examples shown in FIG. 3 and FIG. 4, use of the pair of hydraulic pumps 30, 31 makes it possible to distribute the discharging pressure among the onward passage from the helm pump 10 to the cylinder 20 and the return passage from the cylinder 20 to the helm pump 10, so that the movement of the liquid in the hydraulic circuit 14 becomes more uniform and stabilized. Even when one of the hydraulic pumps fails, the operation can be continued with the other hydraulic pump. Moreover, requirement for the discharging power of each hydraulic pump can be made smaller, so that smaller pumps can be used satisfactorily in combination with the hydraulic circuit 14.

Another example of a preferable steering apparatus according to the present invention will be described below with reference to FIG. 5 through FIG. 11. The constitutions shown in FIG. 5 through FIG. 11 correspond to the tenth through fourteenth features.

In contrast to the constitutions shown in FIG. 1 and FIG. 2 that employ the hydraulic pump 30 capable of discharging in both ways 30 as the hydraulic pump of the pump means, the apparatus of this example is provided with a hydraulic pump 32 capable of discharging only in one direction 32 that is installed in series in the hydraulic circuit 15.

A three-position switching valve 60 is provided as the passage switching means.

The hydraulic circuit 15 has a pair of helm pump passages 15*a*, 15*b* installed between the helm pump 10 and the pilot switching valve 60, a pair of hydraulic pump passages 15*c*, 15*d* installed between the pilot switching valve 60 and the hydraulic pump 32 and a pair of cylinder hydraulic circuits 15*e*, 15*f* installed between the pilot switching valve 60 and the cylinder 20.

The three-position switching valve 60 is a 6-port switching valve of sliding spool type, and has block center construction (all-port block). That is, the valve comprises three valve chambers 61, 62, 63, while the switching valve central chamber 61 has six ports; a pair of hydraulic pump ports 61*c*, 61*d* that constitute the connecting ports for the pair of hydraulic pump passages 15*c*, 15*d* of the hydraulic pump 32 and a pair of cylinder ports 61*e*, 61*f* that constitute the connecting ports for the pair of cylinder hydraulic circuits 15*e*, 15*f*, with all the ports 61*a* through 61*f* being closed.

The rotary switching valve right chamber 62 has a pair of helm pump ports 62*a*, 62*b*, a pair of hydraulic pump ports 62*c*, 62*d* and a pair of cylinder ports 62*e*, 62*f*. The port 62*a* communicates with the port 62*d*, the port 62*b* communicates with the port 62*f*, and the port 62*c* communicates with the port 62*e*.

The switching valve left chamber 63 has a pair of helm pump ports 63*a*, 63*b*, a pair of hydraulic pump ports 63*c*, 63*d* and a pair of cylinder ports 63*e*, 63*f*. The port 63*a* communicates with the port 63*e*, the port 63*b* communicates with the port 63*d*, and the port 63*c* communicates with the port 63*f*.

A pair of pilot passages 65, 66 and return-urging springs 67, 68 are provided as the passage switching means.

When the steering wheel 13 is operated to rotate the helm pump 10 counterclockwise and discharge the liquid from the left port 12, the liquid is forced from the left port 12 of the helm pump into the helm pump passage 15*b* so that the pressure in the pilot passage 66 is increased and the pressure in the other pilot passage 65 decreases. As a result, the pilot pressure is generated so that the pilot switching valve 60 moves to the right in the positional relationship shown in FIG. 5, thereby to enter the state shown in FIG. 6. In this case, the liquid discharged from the left port 12 of the helm pump 10 into the helm pump passage 15*b* is sent through the helm pump port 63*b* of the switching valve left chamber 63, the hydraulic pump port 63*d* and the hydraulic pump passage 15*d* into the suction port of the hydraulic pump 32 capable of discharging only in one direction 32. As a result, the liquid enters through the lower port 32*b* into the hydraulic pump 32 to be discharged through the upper port 32*a* into the hydraulic pump passage 15*c*, and flows through the hydraulic pump port 63*c*, the cylinder port 63*f* and the cylinder hydraulic circuit 15*f* into the cylinder left chamber 26 via the left port 24 of the cylinder. This causes the piston 21 to move to the right in the positional relationship shown in FIG. 6, thereby moving the rudder 27 (see FIG. 1). At the same time, the same amount of liquid as that introduced is discharged from the cylinder right chamber 25 through the cylinder right port 23 into the cylinder hydraulic circuit 15*e*, and is transmitted through the cylinder port 63*e*, the helm pump port 63*a* and the helm pump passage 15*a*, thereby to enter the helm pump 10 via the right port 11 of the helm pump.

When the helm pump 10 rotates clockwise by the steering operation and discharges the liquid from the right port 11 into the helm pump passage 15*a*, on the other hand, the pressure in the pilot passage 65 is increased and the pressure in the other pilot passage 66 decreases. As a result, the pilot pressure is generated so that the pilot switching valve 60 moves to the left in the positional relationship shown in FIG. 5, thereby to enter the state shown in FIG. 7. In this case, the liquid discharged from the right port 11 of the helm pump 10 into the helm pump passage 15*a* is sent through the helm pump port 62*a* of the rotary switching valve right chamber 62, the hydraulic pump port 62*d* and the hydraulic pump passage 15*d* into the suction port of the hydraulic pump 32 capable of discharging only in one direction 32. As a result, the liquid discharged from the hydraulic pump 32 into the hydraulic pump passage 15*c* flows through the hydraulic pump port 62*c*, the cylinder port 62*e* and the cylinder hydraulic circuit 15*e* into the cylinder right chamber 25 via the right port 23 of the cylinder. This causes the piston 21 to move to the left in the positional relationship shown in FIG. 7, thereby moving the rudder 27 (see FIG. 1). At the same time, the same amount of liquid as that introduced is discharged from the cylinder left chamber 26 through the cylinder left port 24 into the cylinder hydraulic circuit 15*f*, and is transmitted through the cylinder port 62*f*, the helm pump passage 62*b* and the helm pump passage 15*b*, thereby to enter the helm pump 10 via the left chamber 12 of the helm pump.

Figure 5:
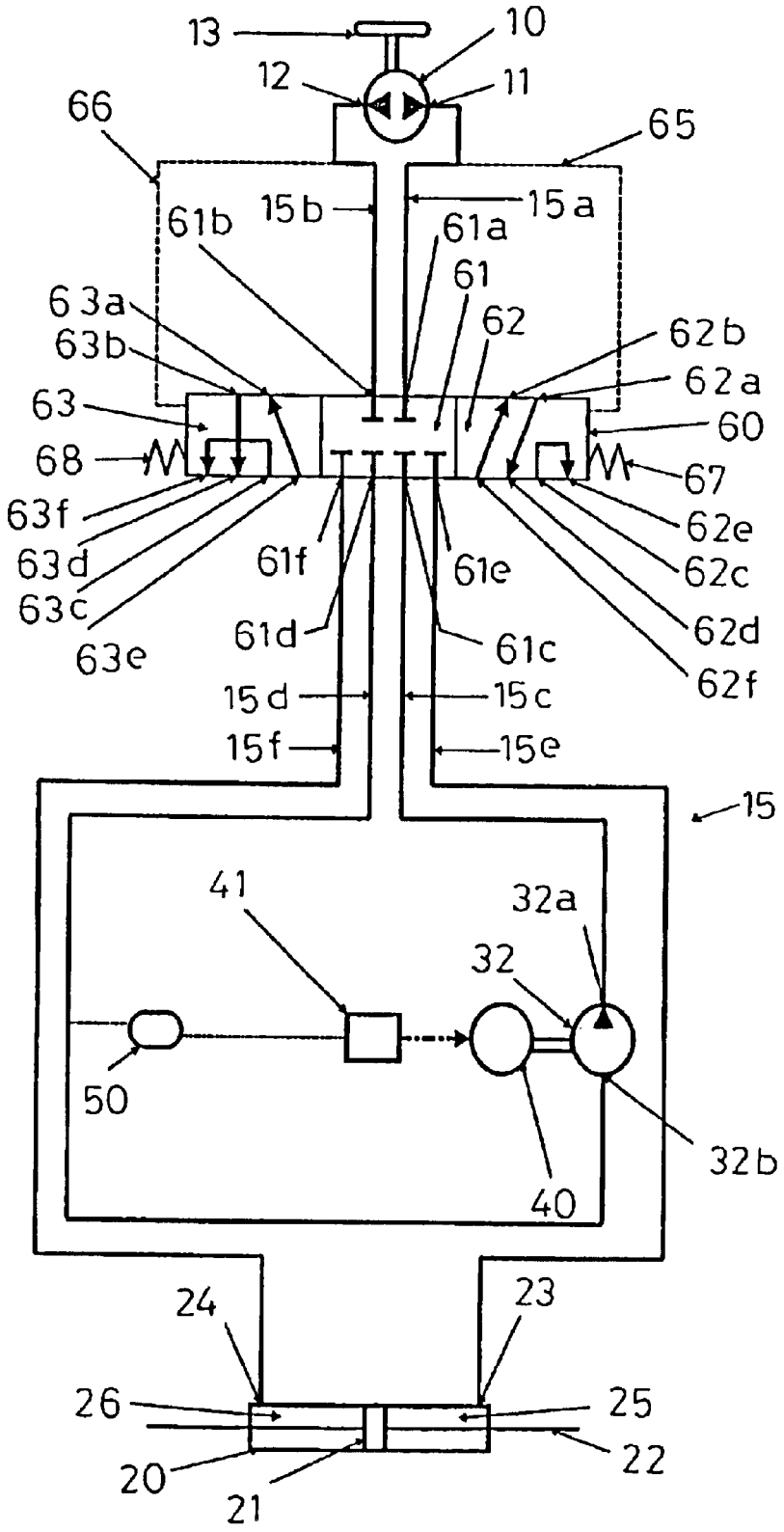
Figure 6:
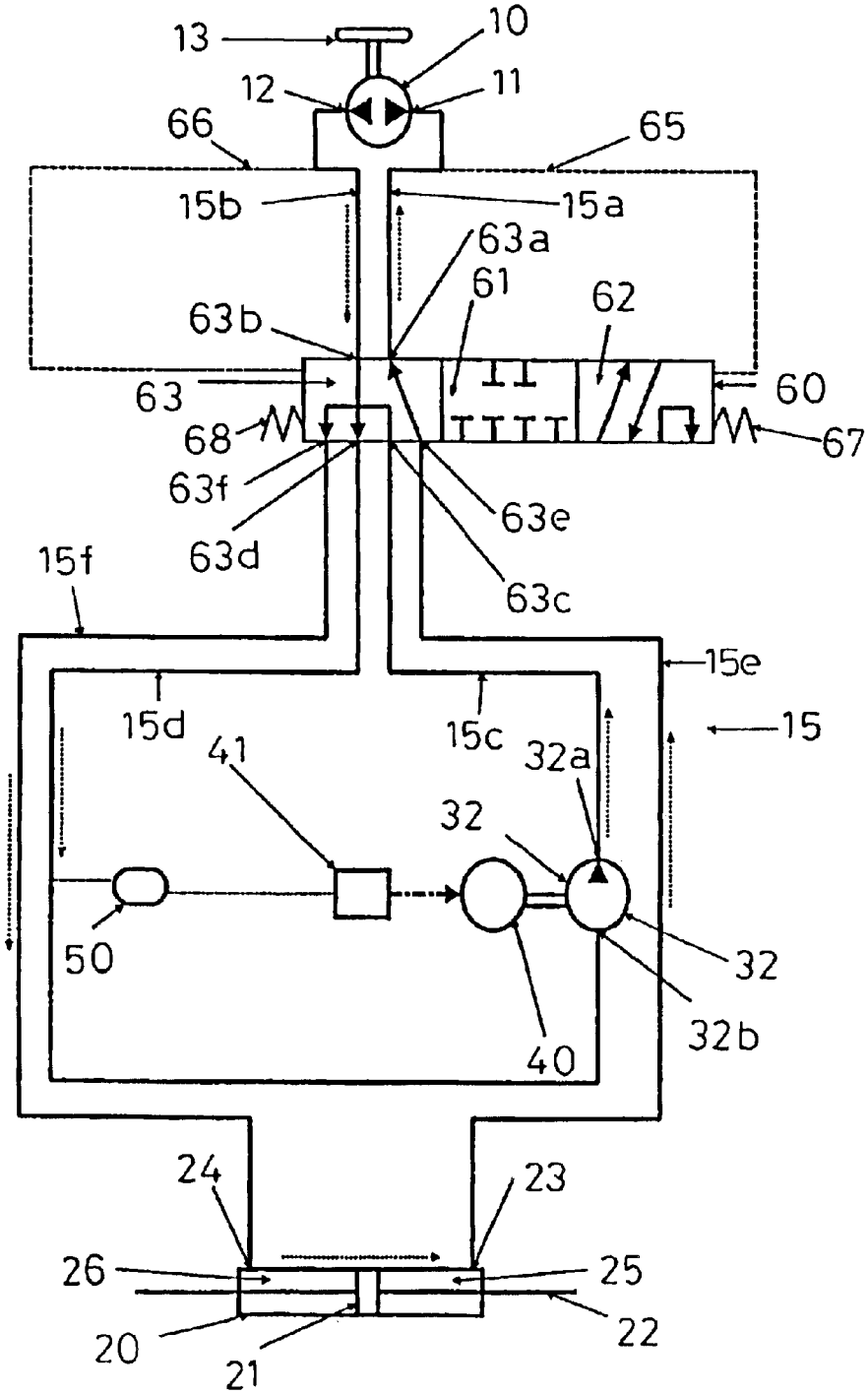
Figure 7:
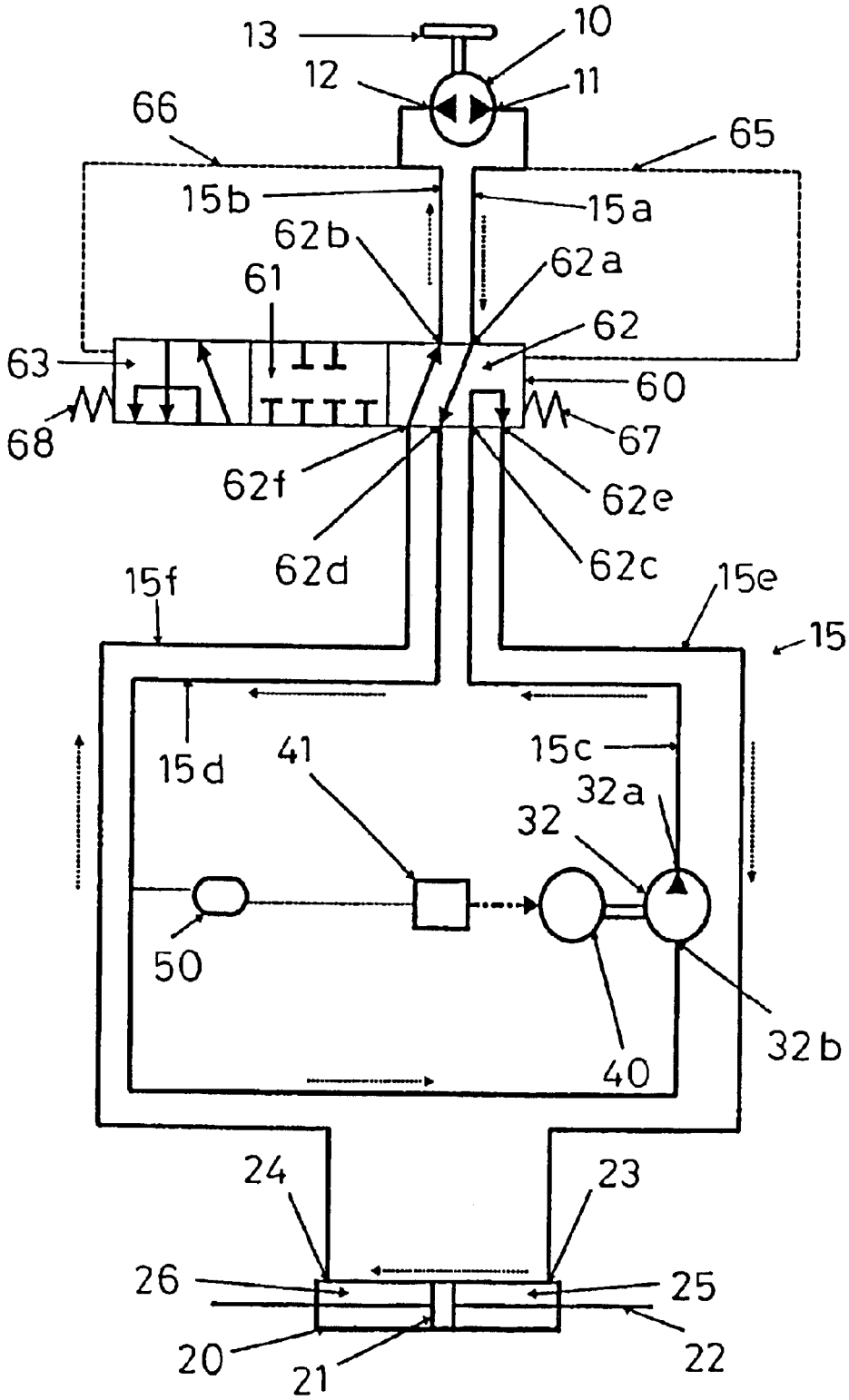

In the apparatus shown in FIG. 5 through FIG. 7, control by means of the pump means is carried out similarly to that in the apparatus shown in FIG. 1. In this case, however, one pressure detector 50 is provided only in the hydraulic pump passage 15*d* that is connected to the discharge port of the helm pump 10 regardless of which direction the helm pump 10 rotates to discharge the liquid. When the helm pump 10 rotates in either one direction to discharge the liquid, the pressure at the suction side of the helm pump 10 decreases toward a negative value, but actually reaches a level near the atmospheric pressure due to the buffer effect of the hydraulic circuit. Therefore, the resistive pressure generated by rotation of the helm pump 10 can be detected by installing the pressure detector only in the discharging side of the helm pump 10, not on both the discharging side and the suction side of the helm pump 10. In this example, since the pressure on the discharging side of the helm pump 10 can always be detected by installing the pressure detector in the hydraulic pump passage 15*d*, one pressure detector and the pressure subtraction circuit can be eliminated. Therefore, in this example, the pressure detected by the pressure detector 50 is input as the resistive pressure generated by rotation of the helm pump 10 into the motor drive circuit 41. The motor drive circuit 41 controls the pump motor 40 in accordance to the resistive pressure that has been input.

In the example shown in FIG. 1 through FIG. 4, too, resistive pressure can be determined by detecting the pressure on the discharging side of the helm pump 10 with one pressure detector. In the case shown in FIG. 1 through FIG. 4, however, since either one of the pair of hydraulic circuits 14*a*, 14*b* can be pressure on the discharging side depending on the rotating direction of the helm pump 10, a pressure detector is required in each either one of the hydraulic circuits 14*a*, 14*b*.

Figure 8:
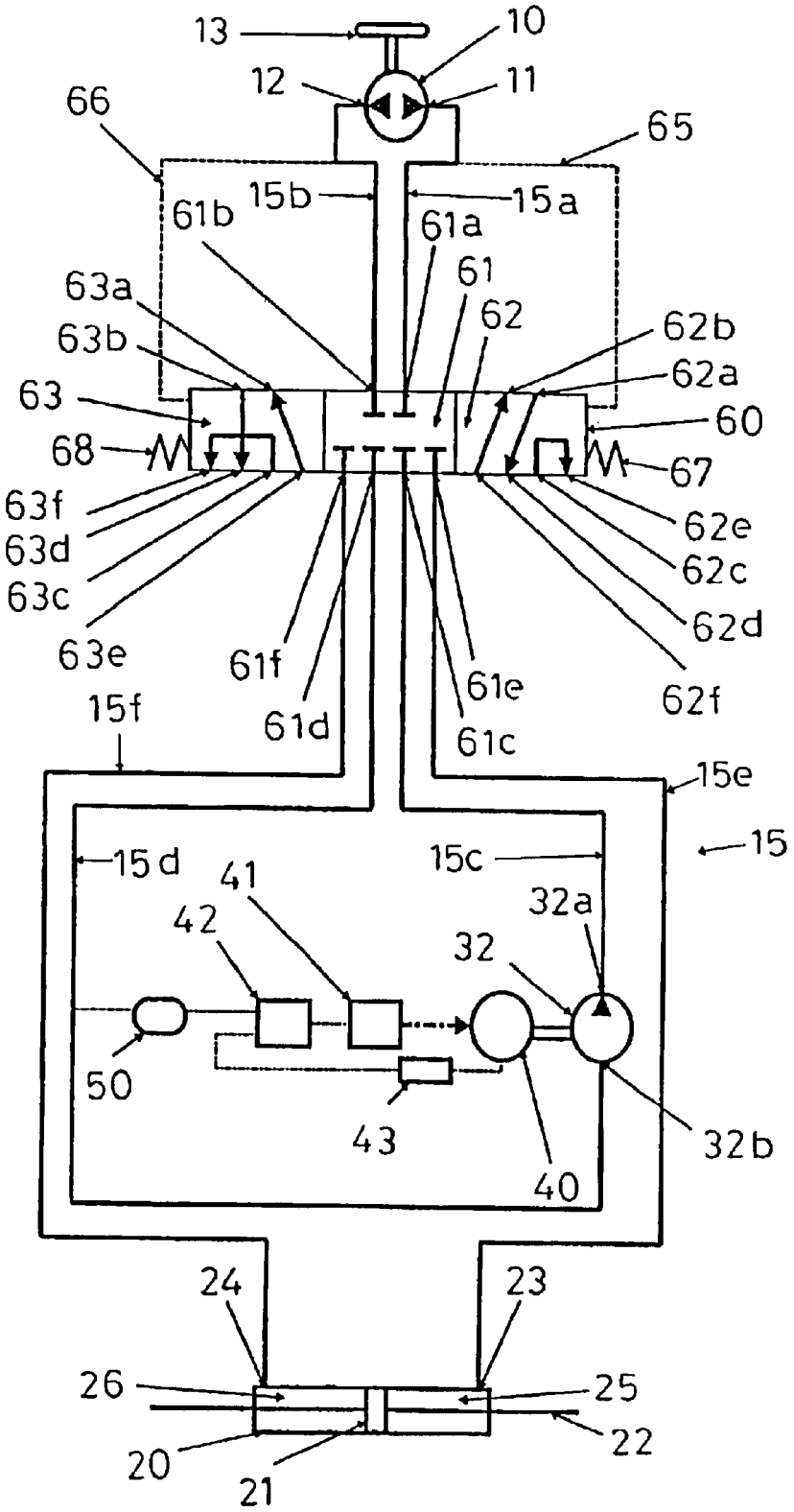
Figure 9:
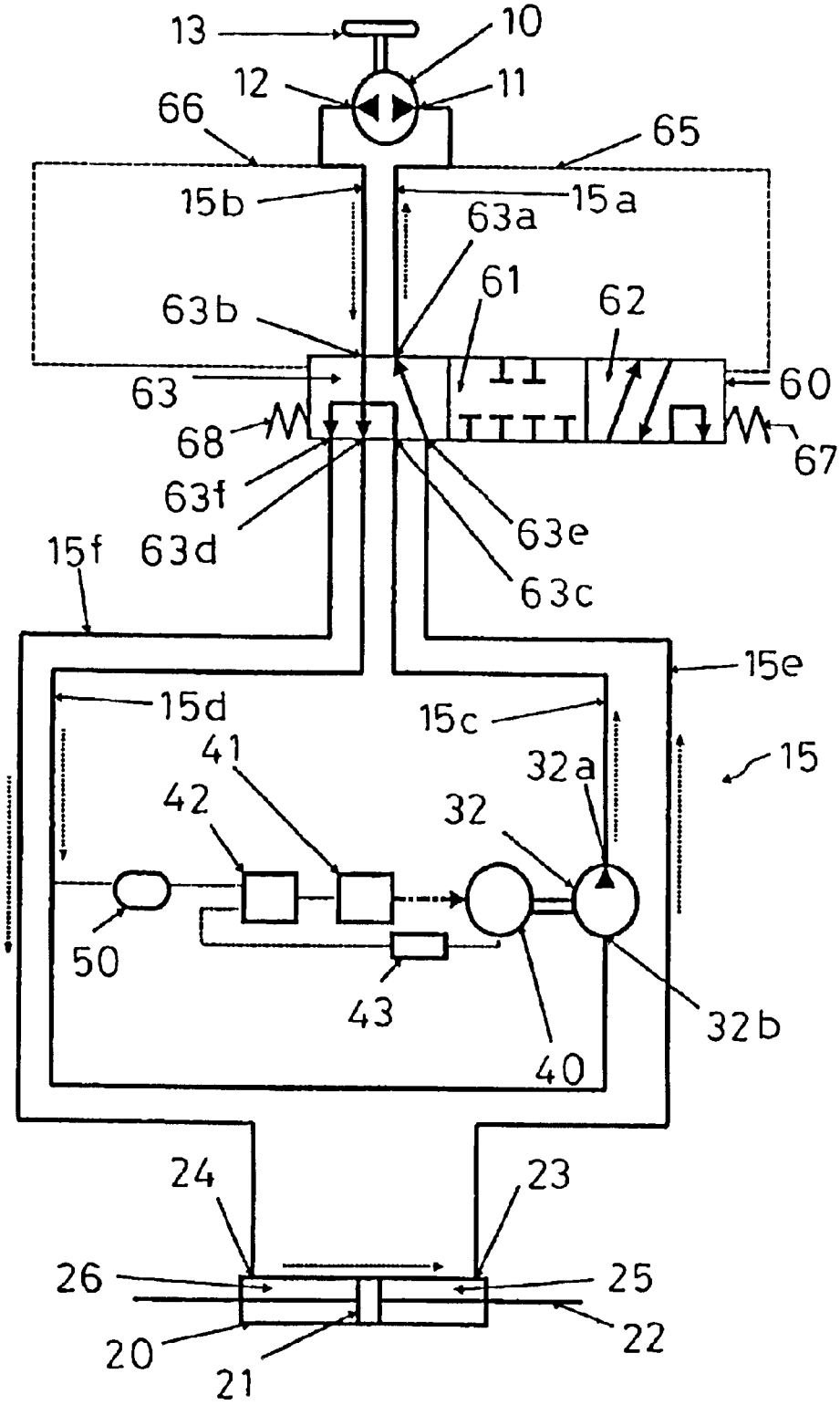
Figure 10:
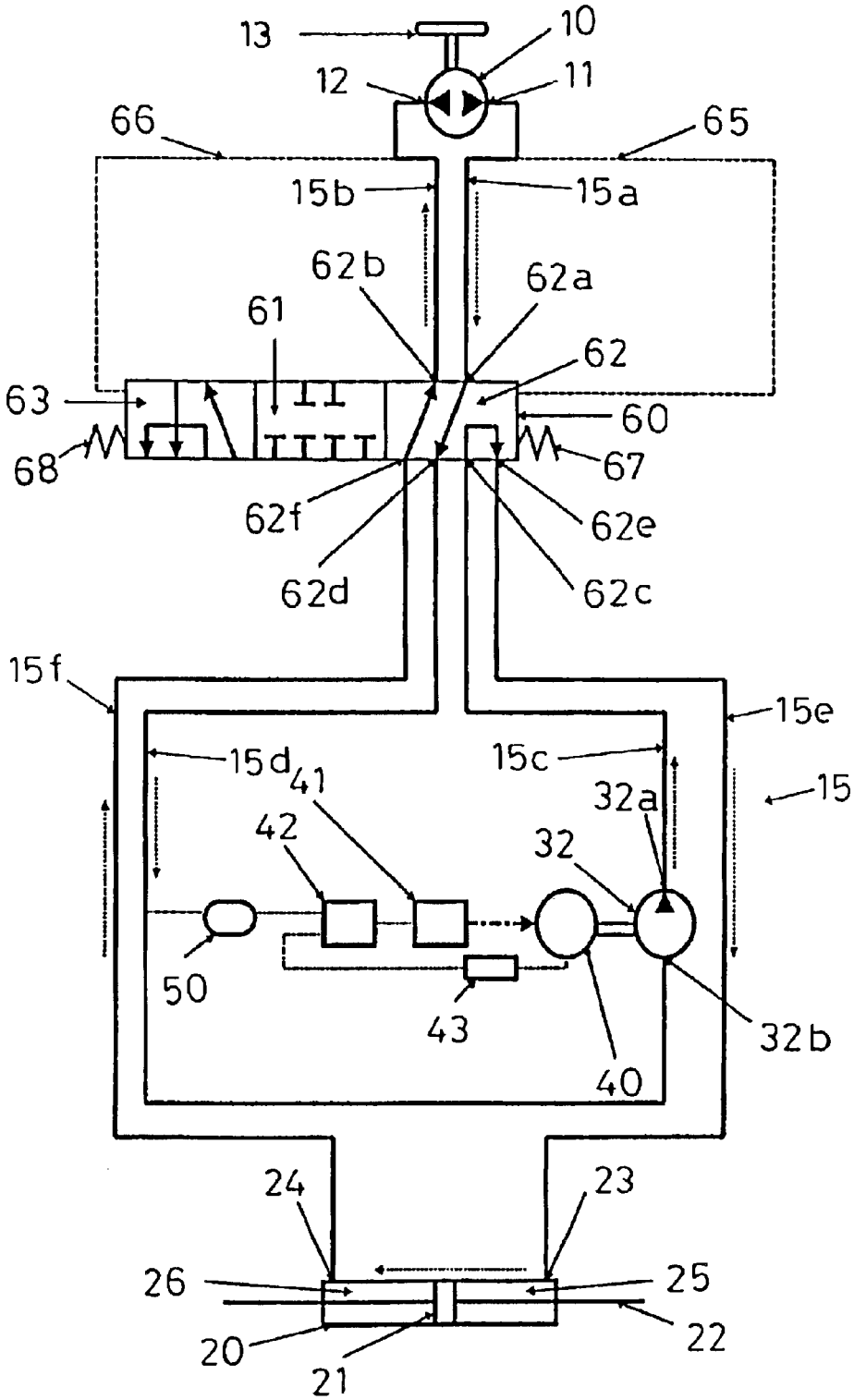

In the apparatus shown in FIG. 8 through FIG. 10, control by means of the pump means is carried out similarly to that in the apparatus shown in FIG. 2. Constitution provided with only one pressure detector and the reason for employing this constitution have been described in conjunction with the apparatus shown in FIG. 5 through FIG. 7. Control in this example is carried out by comparing the value detected by the pressure detector 50 and the value detected by the motor current detector 43. The value detected by the pressure detector 50 relates to the resistive pressure against the rotation of the helm pump 10 and the value detected by the motor current detector 43 relates to the discharging pressure of the hydraulic pump 32, and therefore both values can be compared with the same unit. Thus the difference between these values can be regarded as representative of the pressure difference and can be used in proportional control of the hydraulic pump 32, so that the discharging pressures of the hydraulic pump 32 is quickly corrected to a proper values and achieve stabilization quickly at the proper pressure.

In the example shown in FIG. 5 through FIG. 10, use of the hydraulic pump 32 capable of discharging only in one direction makes the constitution of the hydraulic circuit somewhat more complex, and makes it necessary to use the complex 6-port switching valve as the passage switching means. At the same time, simple and inexpensive hydraulic pump can be used, and the use of the hydraulic pump 32 capable of discharging only in one direction has an advantage that the control mechanism such as the pump drive circuit can be of simple constitution. Also one unit of the pressure detector 50 suffices and the pressure subtraction circuit can be eliminated.

Figure 11:
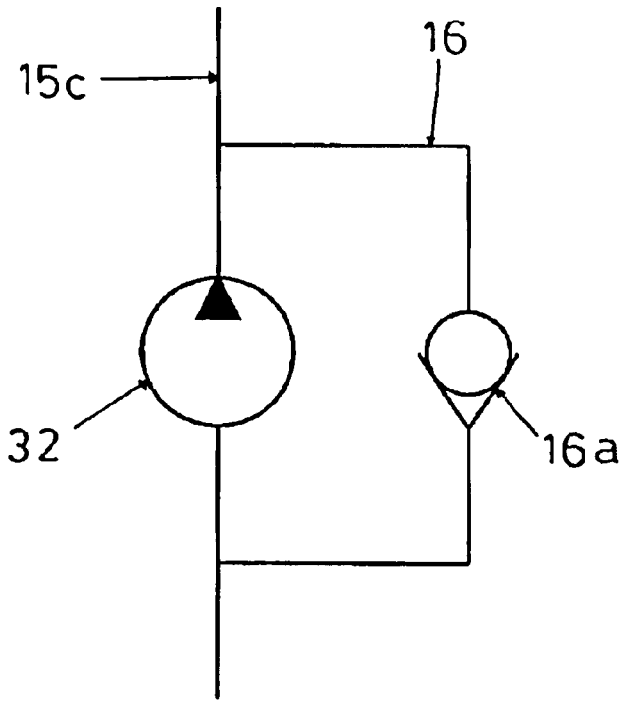

Also in the apparatus example shown in FIG. 5 through FIG. 10, a constitution having a bypass 16 installed for the hydraulic pump 32 as shown in FIG. 11 can be employed. Reference numeral 16*a* denotes a check valve that prevents the liquid from flowing backward from the helm pump 10 toward the cylinder 20. By providing the bypass 16, it is made possible to facilitate manual steering operation by means of the bypass 16 even when the hydraulic pump 32 fails resulting in blocking of the hydraulic circuit. In case a pump that blocks the hydraulic circuit when not in operation is used as the hydraulic pump 32, too, it is made possible to carry out manual steering by using the bypass 16 provided with the check valve 16*a* when the resistance against steering is low, and carry out power-assisted steering by using the hydraulic pump 32 when the resistance against steering increases.

Another example of a preferable steering apparatus according to the present invention will be described below with reference to FIG. 12 through FIG. 18. The constitutions shown in FIG. 12 through FIG. 18 correspond to the fifteenth through nineteenth features.

Similarly to the case of the hydraulic circuit 14 shown in FIG. 1 and FIG. 2 and shown in FIG. 3 and FIG. 4, the hydraulic circuit 14 is constituted from the pair of hydraulic circuits 14*a*, 14*b*.

For the pump means, one unit of the hydraulic pump 32 capable of discharging only in one direction 32 is used similarly to the hydraulic pump 32 shown in FIG. 5 through FIG. 10. The hydraulic pump 32 is installed with the discharging port facing downward toward the cylinder 20 in the positional relationship shown in the drawing.

On the other hand, a pair of 3-position switching valves 70, 80 are installed as the passage switching means between the helm pump 10 and the hydraulic pump 32 and between the hydraulic pump 32 and the cylinder 20. By using the two 3-position switching valves 70, 80, it is made possible to make the hydraulic circuit 14 in a very simple constitution consisting of the pair of hydraulic circuits 14*a*, 14*b*, and use a 4-port switching valve available in the market for the 3-position switching valves 70, 80, thus achieving a great effect of cost reduction.

For the pair of 3-position switching valves 70, 80, a switching valve of sliding spool type is used that has 4-port block center (all-port block) construction. The sliding spool type switching valve is not limited to this constitution, and other type such as rotary type may be employed, as a matter of course.

For the 3-position switching valves 70, 80, an electromagnetic valve consisting of a pair of solenoids is used. That is, the 3-position switching valve 70 has a switching valve central chamber 71, a rotary switching valve right chamber 72 and the switching valve left chamber 73. The chambers 71, 72, 73 have helm pump ports 71*a*, 71*b*, 72*a*, 72*b*, 73*a*, 73*b* and hydraulic pump ports 71*c*, 71*d*, 72*c*, 72*d*, 73*c*, 73*d*. All of the four ports of the central chamber 71 are closed. In the right chamber 72, the port 72*a* and the port 72*d* communicate with each other while crossing, while the port 72*b* and the port 72*c* communicate with each other while crossing. In the left chamber 73, the port 73*a* and the port 73*c* run in parallel to each other, while the port 73*b* and the port 73*d* run in parallel to each other.

Similarly, the other 3-position switching valve 80 has a switching valve central chamber 81, a rotary switching valve right chamber 82 and a switching valve left chamber 83. The chambers 81, 82, 83 have cylinder ports 81*a*, 81*b*, 82*a*, 82*b*, 83*a*, 83*b* and hydraulic pump ports 81*c*, 81*d*, 82*c*, 82*d*, 83*c*, 83*d*. All of the four ports of the central chamber 81 are closed. In the right chamber 82, the port 82*a* and the port 82*d* communicate with each other while crossing, while the port 82*b* and the port 82*c* communicate with each other while crossing. In the left chamber 83, the port 83*a* and the port 83*c* run in parallel to each other, while the port 83*b* and the port 83*d* run in parallel to each other.

A pair of pressure switches 90, 91 are provided to switch the positions of the pair of 3-position switching valves 70, 80, in order to switch the solenoids 76, 77 of the 3-position switching valve 70 and the solenoids 86, 87 of the 3-position switching valve 80.

Figure 12:
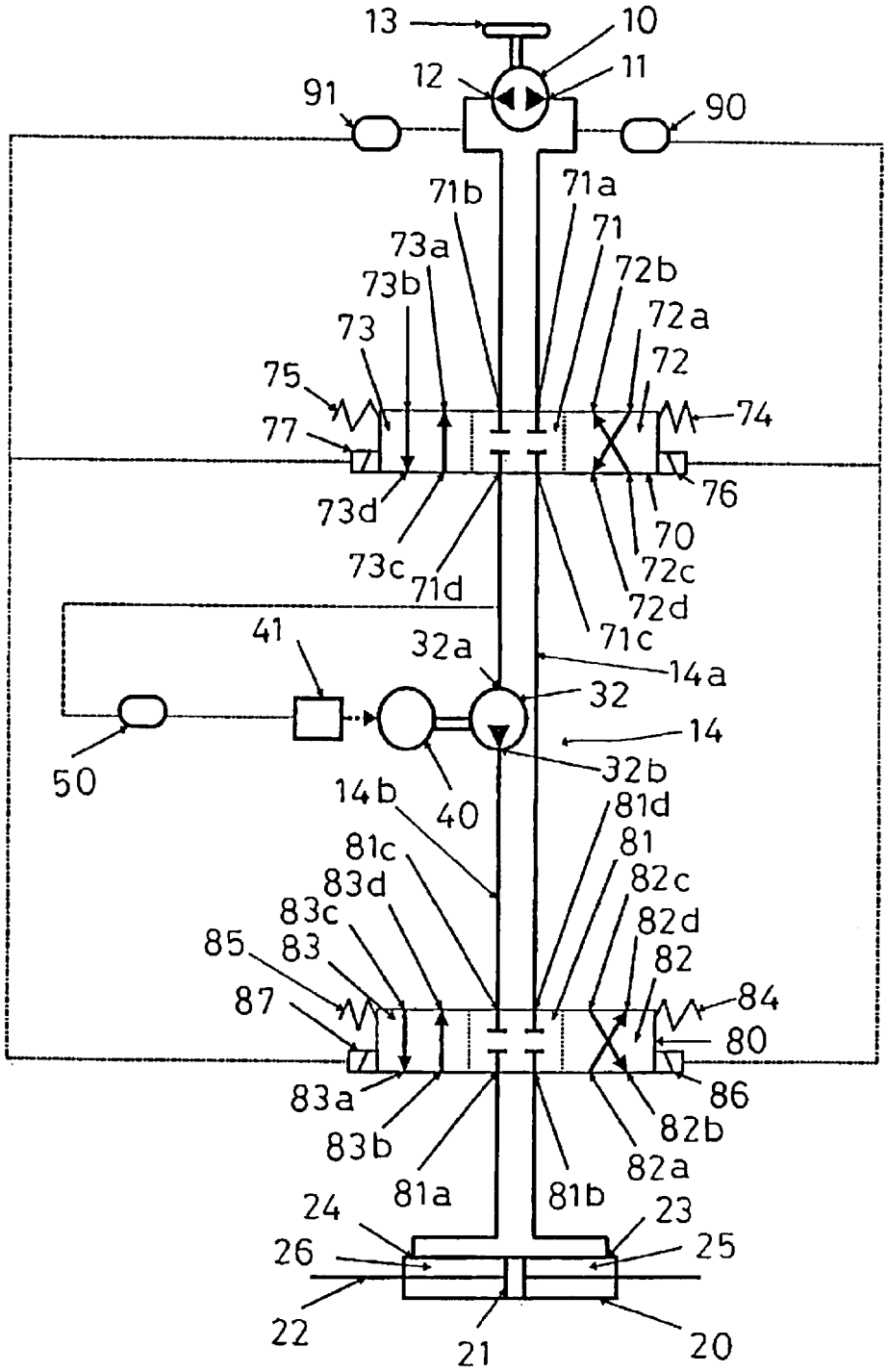
Figure 13:
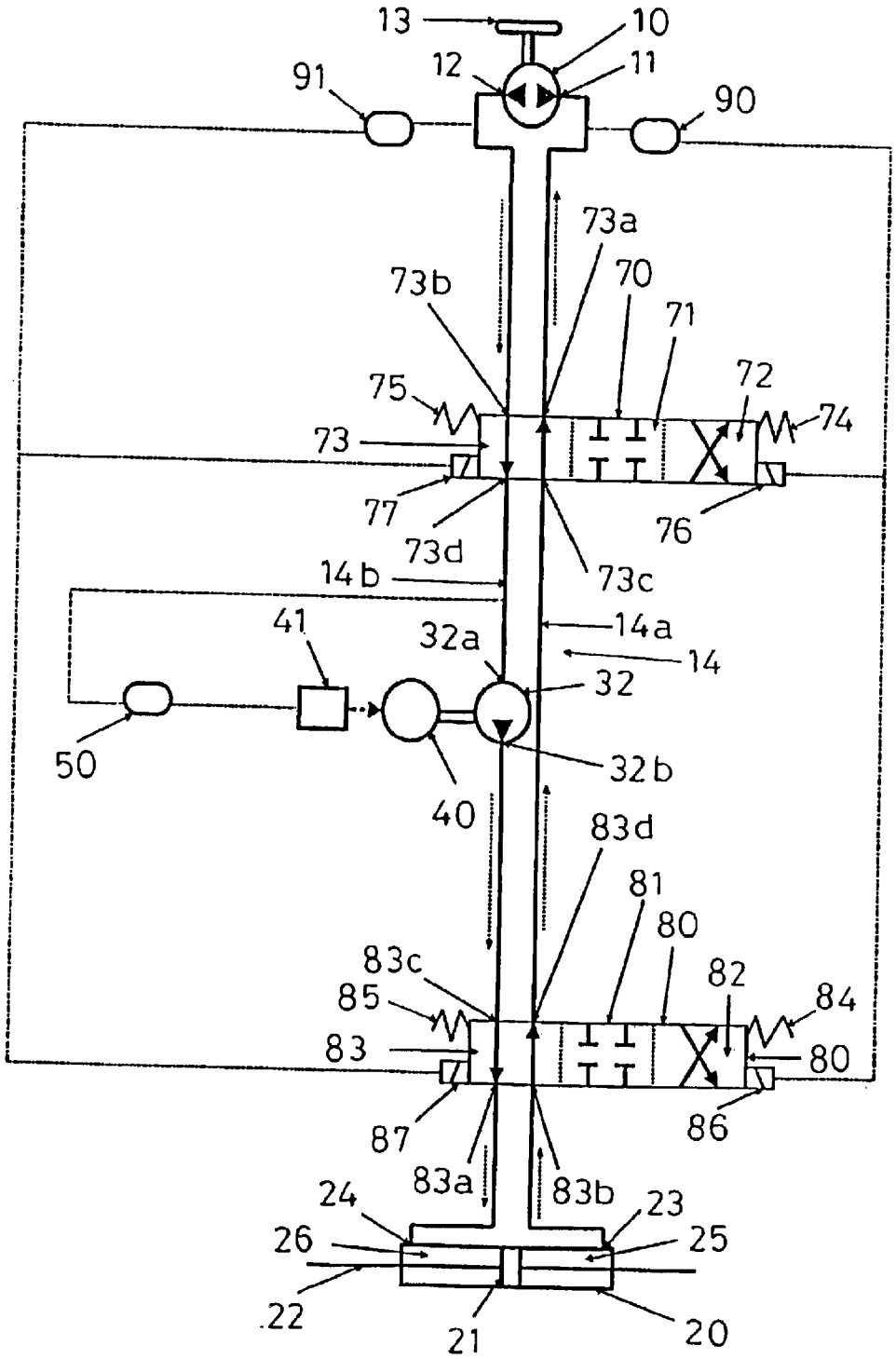

When the steering wheel 13 is operated so that the helm pump 10 rotates counterclockwise to discharge the liquid from the left port 12 and increase the pressure, the left pressure switch 91 is turned on and activates the solenoids 78, 87, so as to move the 3-position switching valves 70, 80 to the right in the positional relationship shown in FIG. 12, thereby to take the position shown in FIG. 13. In the position of the 3-position switching valves 70, 80 shown in FIG. 13, the hydraulic circuits do not cross each other and the liquid discharged from the left port 12 of the helm pump passes through the ports 73*b*, 73*d* of the 3-position switching valve 70, the upper port 32*a* which is the suction port of the hydraulic pump 32, the lower port 32*b* which is the discharging port and the ports 83*c*, 83*a* of the 3-position switching valve 80 into the left chamber 26 of the cylinder 20 as indicated by the arrow, thereby to push the piston 21 to the right in the positional relationship shown in the drawing. The liquid discharged from the right chamber of the cylinder by the movement of the piston 21 passes through the ports 83*b*, 83*c* of the 3-position switching valve 80 and the ports 73*c*, 73*a* of the 3-position switching valve 70 and flows into the helm pump 10 through the right port 11.

Figure 14:
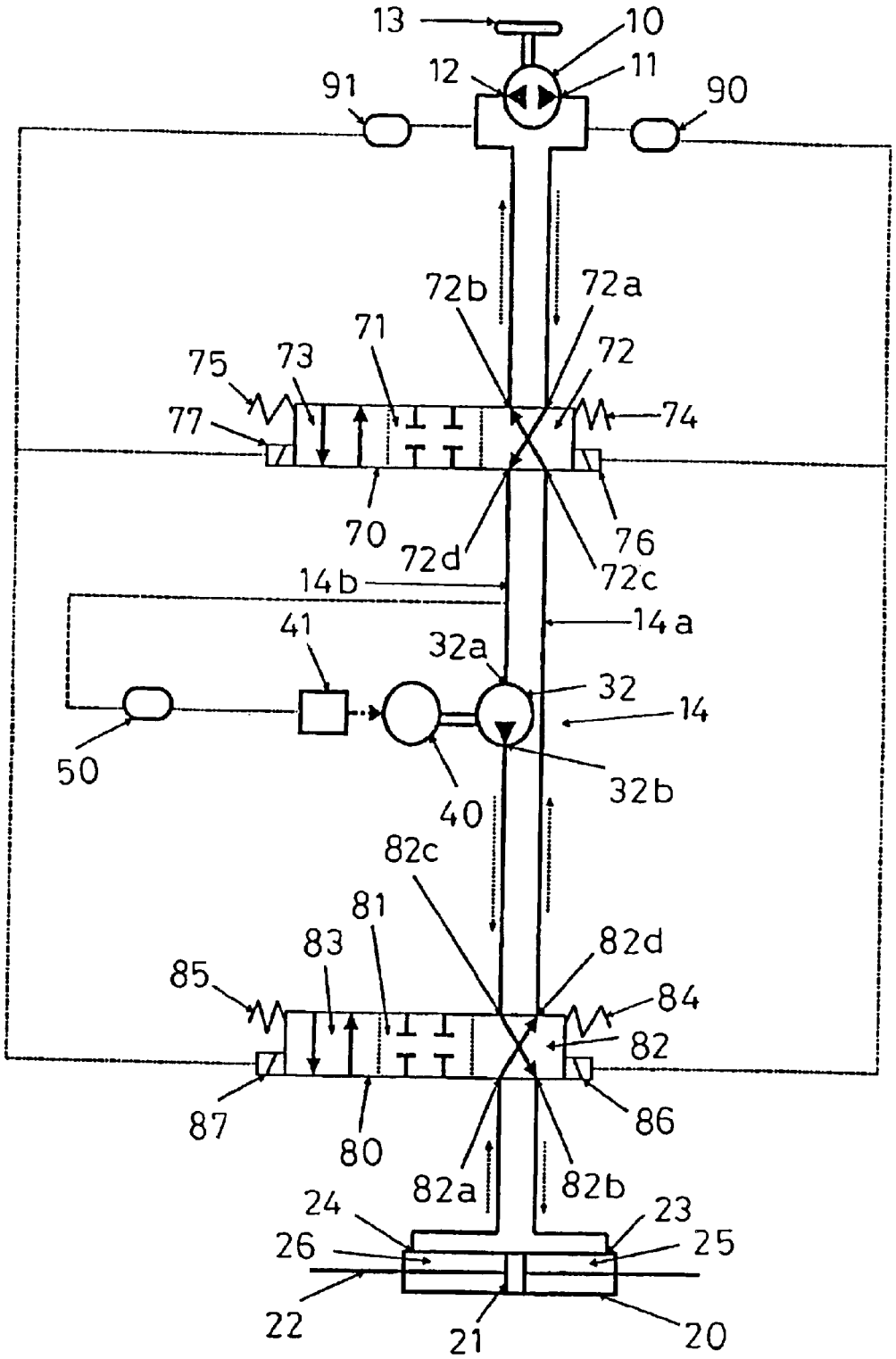

When the steering wheel 13 is operated so that the helm pump 10 rotates clockwise to discharge the liquid from the right port 11 and increase the pressure, the right pressure switch 90 is turned on and activates the solenoids 76, 86, so as to move the 3-position switching valves 70, 80 to the right in the positional relationship shown in FIG. 12, thereby to take the position shown in FIG. 14. In the position of the 3-position switching valves 70, 80 shown in FIG. 14, the hydraulic circuits cross each other twice. That is, the liquid discharged from the right port 11 of the helm pump 10 passes from the port 72*a* to the port 72*d* of the 3-position switching valve 70 through the crossing hydraulic circuits to enter the suction port of the hydraulic pump 32, then flows into the hydraulic pump 32 through the upper port 32*a* and is discharged through the lower port 32*b* as indicated by the arrow. The discharged liquid 10 passes from the port 82*c* to the port 82*b* of the 3-position switching valve 80 again through the crossing hydraulic circuits so as to enter the right chamber 25 of the cylinder 20, thereby to push the piston 21 to the left in the positional relationship shown in the drawing. The liquid discharged from the left chamber 26 of the cylinder by the movement of the piston 21 passes from the port 82*a* to the port 82*d* of the 3-position switching valve 80 through the crossing hydraulic circuits, and further passes from the port 72*c* to the port 72*b* of the 3-position switching valve 70 through the crossing hydraulic circuits, so as to flow into the helm pump 10 through the left port 12.

In the apparatus shown in FIG. 12 through FIG. 14, control by means of the pump means and the effect thereof are similar to those in the apparatus shown in FIG. 1 and the apparatus shown in FIG. 5 through FIG. 7. In this example, one unit of the pressure detector 50 is provided similarly to the apparatus shown in FIG. 5 through FIG. 7.

Figure 15:
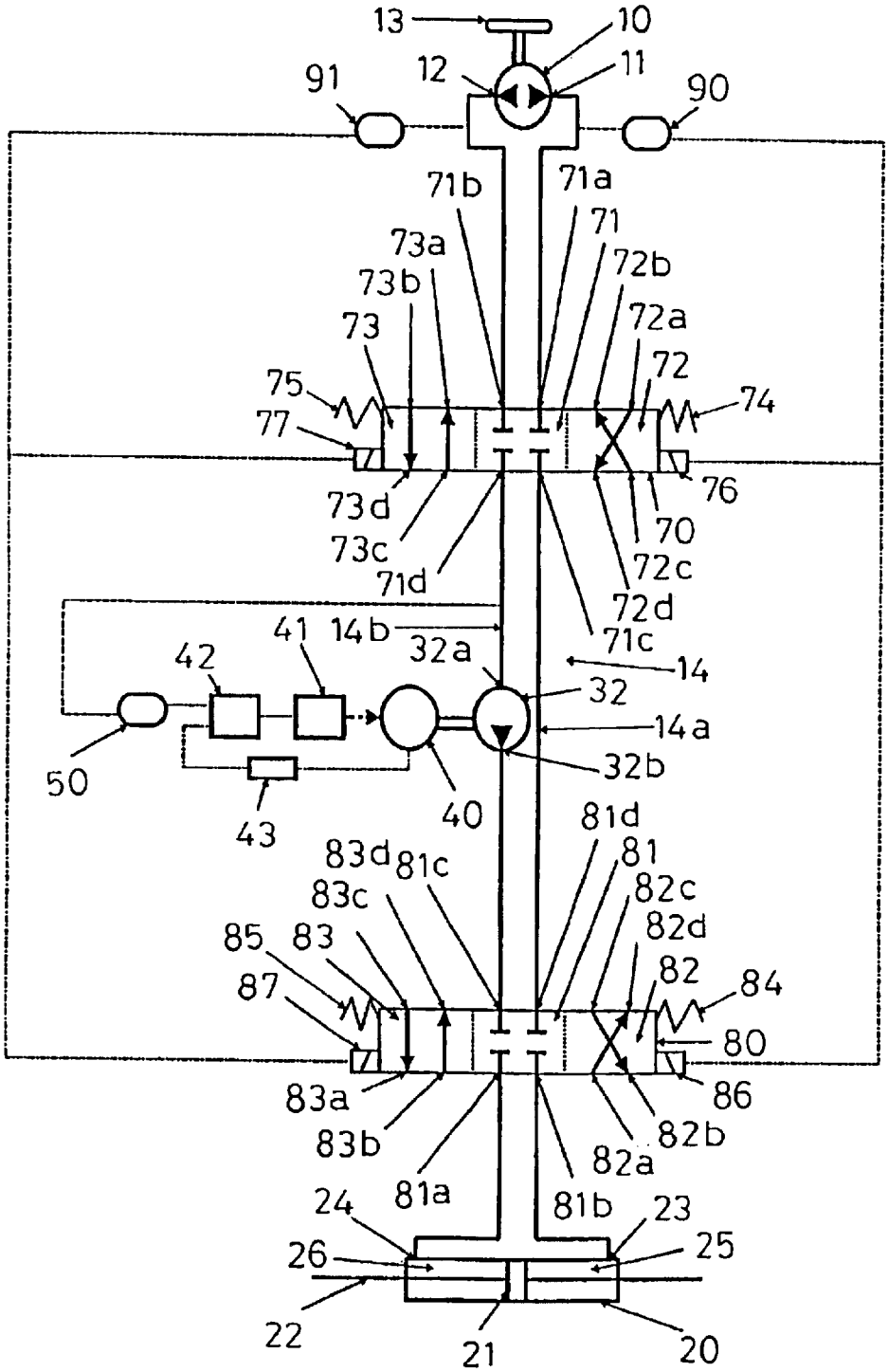
Figure 16:
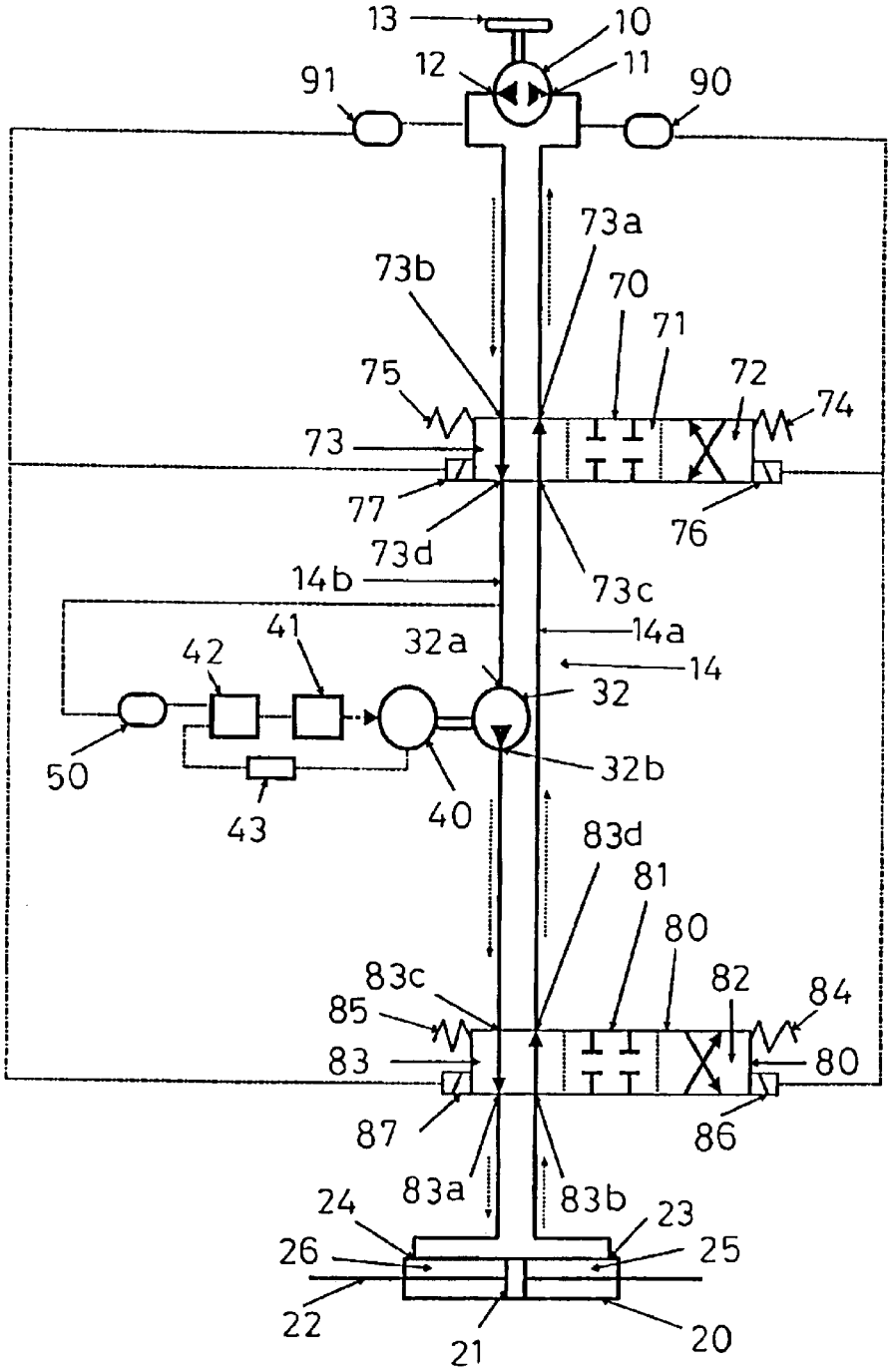
Figure 17:
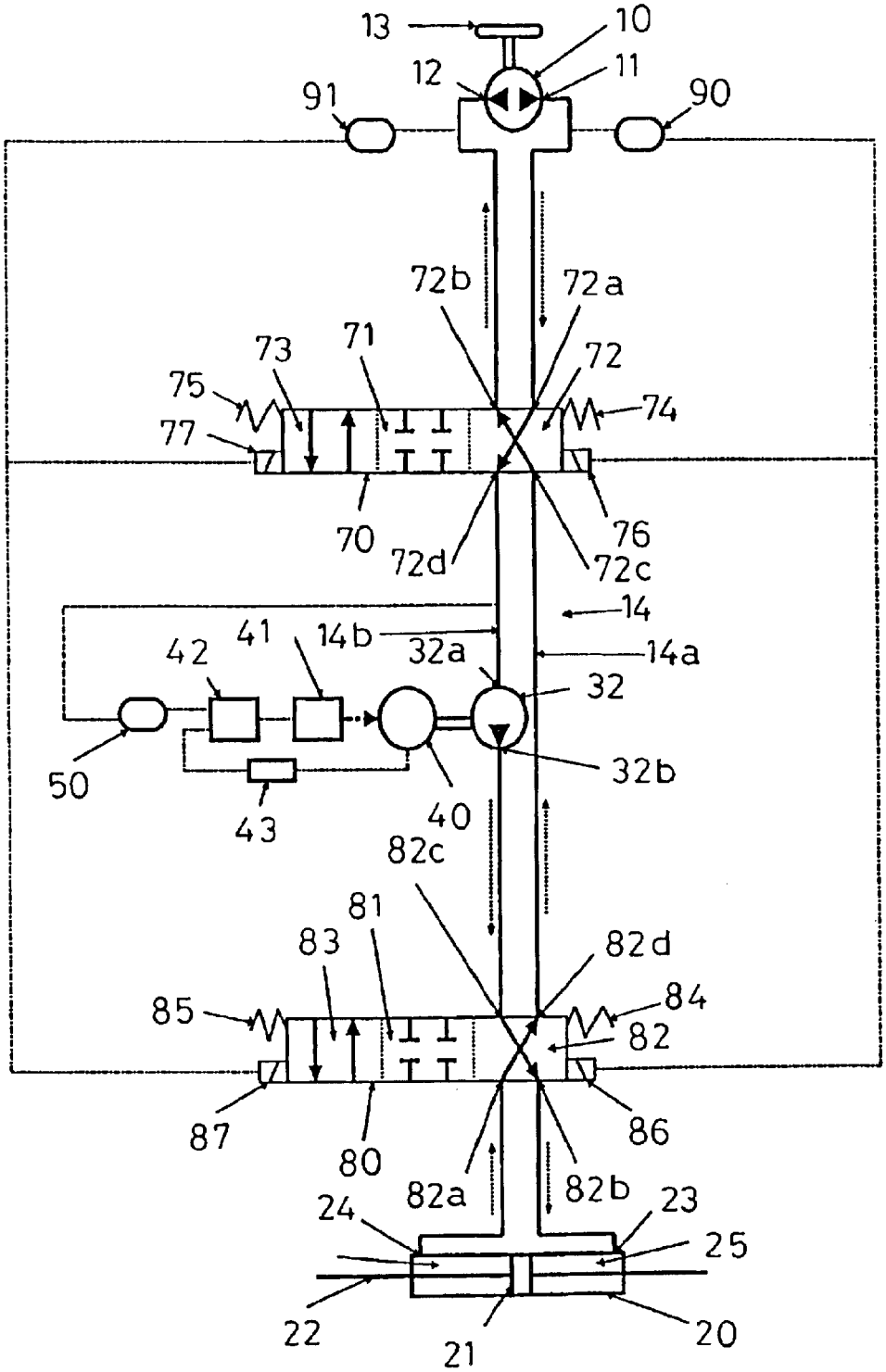

In the apparatus shown in FIG. 15 through FIG. 17, control by means of the pump means and the effect thereof are similar to those in the apparatus shown in FIG. 2 and the apparatus shown in FIG. 8 through FIG. 10.

Figure 18:
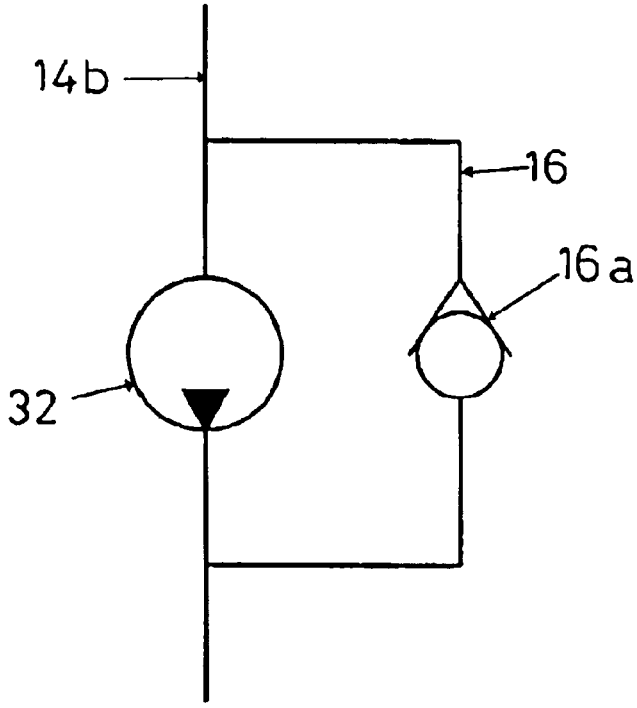

In the apparatus shown in FIG. 12 through FIG. 17, a constitution having the bypass 16 installed for the hydraulic pump 32 as shown in FIG. 18 may be employed. Reference numeral 16*a* denotes a check valve that prevents the liquid from flowing backward from the helm pump 10 toward the cylinder 20. By providing the bypass 16, it is made possible to facilitate manual steering operation by means of the bypass 16 even when the hydraulic pump 32 fails resulting in blocking of the hydraulic circuit, as described in conjunction with the apparatus shown in FIG. 11. In case a pump that blocks the hydraulic circuit when not in operation is used as the hydraulic pump 32, too, it is made possible to carry out manual steering by using the bypass 16 provided with the check valve 16*a* when the resistance against steering is low, and carry out power-assisted steering by using the hydraulic pump 32 when the resistance against steering increases.

An example of preferable steering apparatuses according to the present invention will be described below with reference to FIG. 19 and FIG. 20. The constitution shown in FIG. 19 and FIG. 20 corresponds to the twentieth through twentyfourth features.

In this example, in case the hydraulic circuit has the constitution shown in FIG. 1 and FIG. 2, the hydraulic circuit 14 comprising the pair of passages 14*a*, 14*b* is provided similarly to the case shown in FIG. 3 and FIG. 4 and the case of the hydraulic circuit 14 shown in FIG. 12 through FIG. 17.

For the pump means, a pair of hydraulic pumps 33, 34 capable of discharging only in one direction are provided. The pair of hydraulic pumps 33, 34 are both disposed so that the discharging direction faces downward left in the positional relationship shown in the drawing. The pumps 33, 34 share the common pump motor 40 and the pump drive circuit 41. When the pump motor 40 rotates clockwise, only the hydraulic pump 33 runs and, when the pump motor 40 rotates counterclockwise, only the hydraulic pump 34 runs.

The pair of hydraulic pumps 33, 34 have bypasses 17, 18 that are provided with pilot check valves 17*a*, 18*a*, respectively. The pilot check valves 17*a*, 18*a* are provided with pilot control pipes 17*b*, 18*b*. The pilot check valve 17*a* normally functions as an ordinary check valve, but loses the check valve function and turns into a mere passage when pilot pressure is applied from the pilot control pipe 18*b* to the pilot check valve 17*a*. Similarly, the pilot check valve 18*a* loses the check valve function and turns into a mere passage when pilot pressure is applied from the pilot control pipe 17*b* to the pilot check valve 18*a*.

When the steering wheel 13 is operated so that the helm pump 10 rotates counterclockwise to discharge the liquid from the left port 12, the pressures are detected by the pair of pressure detectors 50, 51, and a positive resistive pressure is determined by the pressure subtraction circuit 52, so that the pump motor 40 rotates clockwise so as to drive only the hydraulic pump 33 of the hydraulic circuits 14*b*, and the helm pump 10 discharges the liquid to the left chamber 26 of the cylinder 20. The liquid introduced into the left chamber 26 of the cylinder moves the piston 21 to the right in the positional relationship shown in the drawing. As the piston 21 moves, the liquid flows out of the right chamber 25 of the cylinder into the hydraulic circuit 14*a*. At this time the pump 34 is not running, and therefore the liquid cannot flow through the hydraulic pump 34 to the helm pump 10 in case such a pump is used that blocks the hydraulic circuit when the pump is not running. In the meantime, since pilot pressure from the hydraulic circuit 14*b* is applied through the pilot control pipe 17*b* to the check valve 18*a* of the bypass 18, the check valve 18*a* turns into a mere passage so that the liquid flows through the bypass 18 into the suction port of the helm pump 10.

When the steering wheel 13 is operated so that the helm pump 10 rotates clockwise to discharge the liquid from the right port 11, only the hydraulic pump 34 of the hydraulic circuits 14*b* operates, as opposed to the case described above where the helm pump 10 rotates counterclockwise. In this case, since pilot pressure from the hydraulic circuit 14*a* is applied through the pilot control pipe 18*b* to the check valve 17*a* of the bypass 17, the check valve 17*a* turns into a mere passage so that the liquid flows through the bypass 17 into the left port 12 on the suction side of the helm pump 10.

Figure 19:
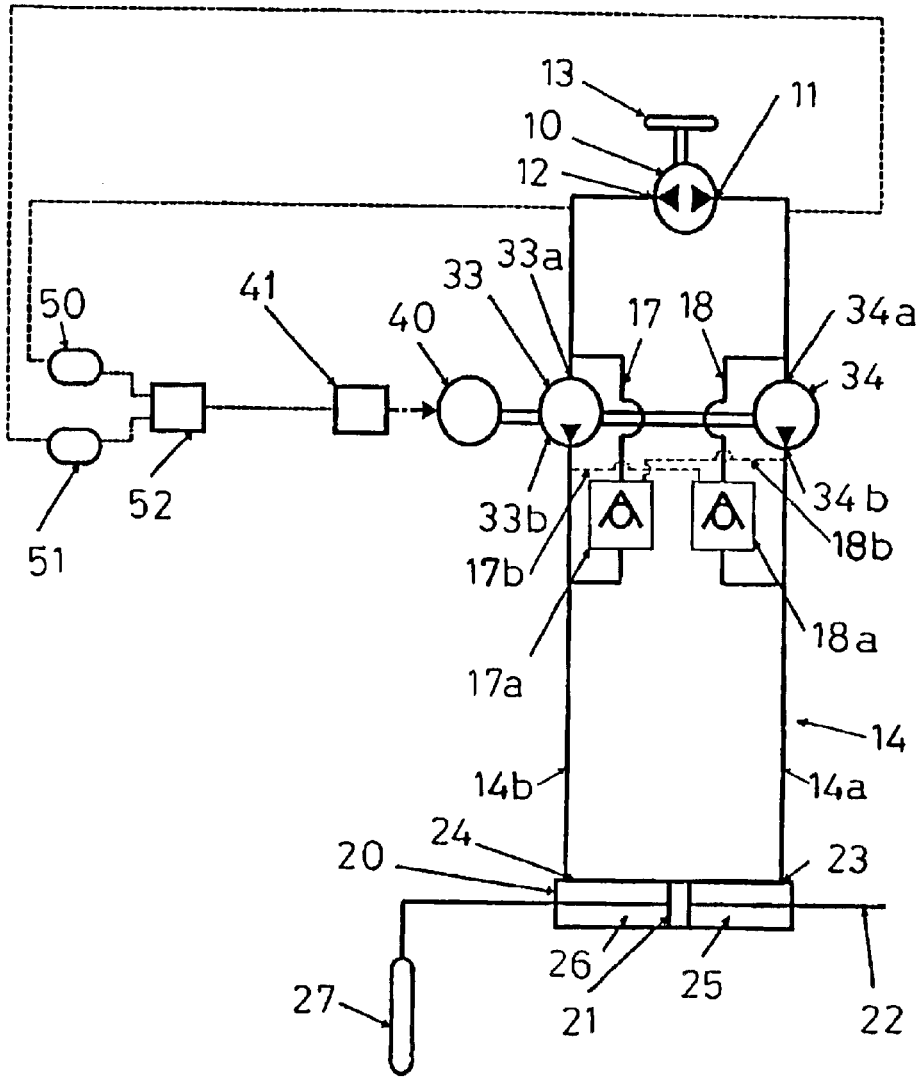

FIG. 19 shows such a constitution as the resistive pressure generated by rotation of the helm pump 10 is determined and control is carried out according to the resistive pressure.

Figure 20:
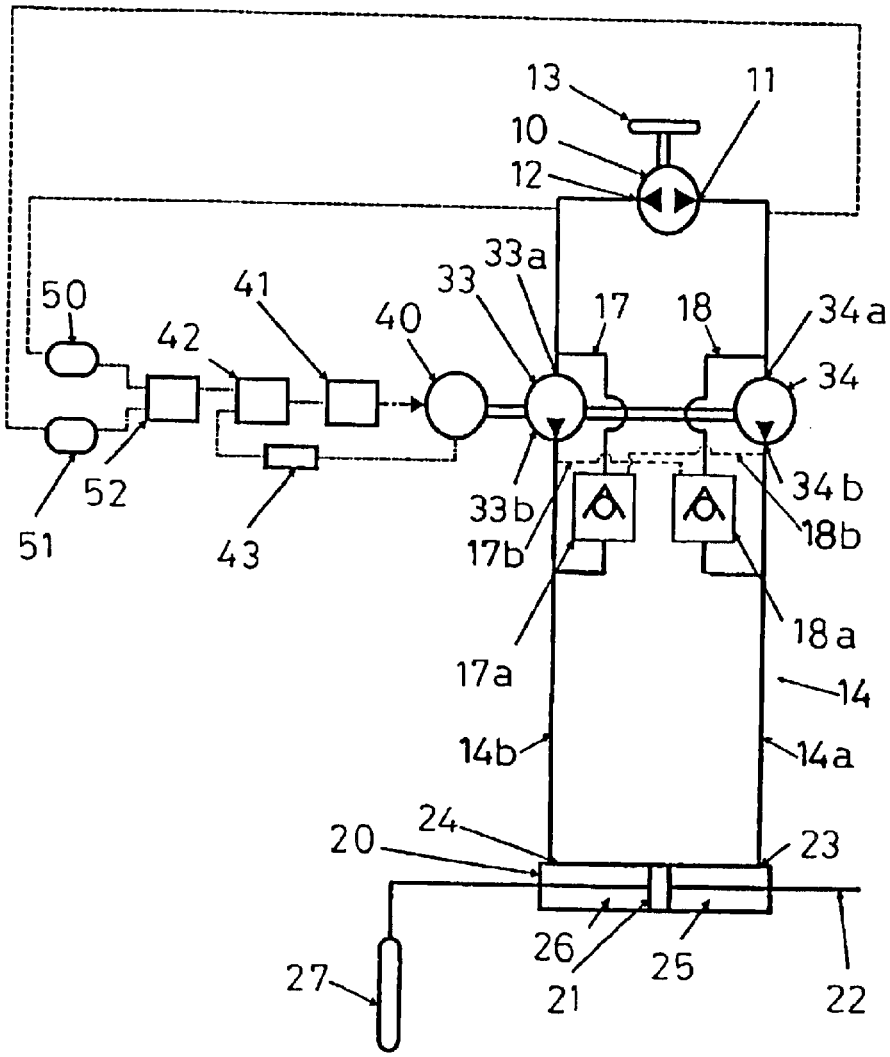

FIG. 20 shows such a constitution as the resistive pressure generated by rotation of the helm pump 10 and he current flowing in the pump motor 40 are determined and compared, so as to control the motor drive circuit 41 according to the difference between the two values. These control operations are similar to those described previously.

The apparatuses shown in FIG. 19 and FIG. 20 may also be operated such as the pump means is driven to facilitate power-assisted steering by using the check valves 17*a*, 18*a* only when the resistive pressure generated by rotation of the helm pump 10 becomes a predetermined level or higher, and manual steering is employed when the resistive pressure is below the predetermined level.

In the case of the examples shown in FIG. 19 and FIG. 20, the apparatus can be switched to manual steering by using the bypasses 17, 18, and the check valves 17*a*, 18*a* even when the pumps 33, 34, or the pump motor 40 fails.

Basic concept of power-assisted steering according to the present invention will be described further below.

In the apparatus shown, in FIG. 1, assume that the steering wheel 13 is turned to rotate the helm pump 10 with a certain torque, so that pressure of the liquid flowing at a flow rate that corresponds to the rotating speed is increased to a level that corresponds to the torque and is discharged from the left port 12 of the helm pump.

The pressure difference is determined by the left pressure detector 50, the right pressure detector 51 and the pressure subtraction circuit 52, with the resultant signal being supplied to the motor drive circuit 41, thereby to drive the pump motor 40 accordingly. When the torque is increased and the pressure difference increases, rotating speed of the pump motor 40 increases.

When the pump motor 40 rotates, the liquid is discharged from the lower port 30*b* of the hydraulic pump 30 so as to flow through the left port 24 of the cylinder 20 and the left chamber 26 of the cylinder, so that the piston 21 and the piston rod 22 move to the right thereby assisting the steering.

When the flow rate that corresponds to the rotating speed of the pump motor 40 driven according to the pressure difference signal detected by the left pressure detector 50, the right pressure detector 51, namely to the rotating speed of the hydraulic pump 30 is equal to the flow rate required for the moving speed of the rudder 27, the rudder 27 continues the movement while maintaining the torque and rotating speed of the steering wheel 13.

When the steering wheel 13 is turned faster by increasing the torque in order to increase the moving speed of the rudder 27, pressure on the discharging side of the helm pump 10 increases thus leading to a larger pressure difference. As a result, rotating speed of the pump motor 40 increases and the discharging flow rate of the hydraulic pump 30 increases, resulting in increased moving speed of the rudder 27. When the moving speed of the rudder 27 increases to a certain level that matches the increased pressure difference, this speed is maintained.

When the steering wheel 13 is turned slowly by decreasing the torque in order to decrease the moving speed of the rudder 27, pressure on the discharging side of the helm pump 10 decreases, thus leading to a smaller pressure difference. As a result, rotating speed of the pump motor 40 decreases and the discharging flow rate of the hydraulic pump 30 decreases, and the moving speed of the rudder 27 reaches equilibrium at the decreased speed.

What should be considered here is how to relate the rotating speed of the pump motor 40 to the pressure difference signal detected by the two pressure detectors 50, 51. This problem will be discussed below.

When the steering wheel 13 is turned with a certain torque and rotating speed, pressure of the liquid in the helm pump 10 is increased, and this value is detected as the differential pressure signal by the left pressure detector 50 and the right pressure detector 51. This signal is used to control the pump motor 40 that is mechanically connected to the hydraulic pump 30. When the required rotating speed is less than the value corresponding to the pressure difference detected, this means that the rotating speed of the pump motor 40 is low. Under this condition, the hydraulic pump 30 discharges less liquid (therefore less liquid is introduced) and larger amount of the liquid is discharged from the helm pump 10, so that the excess liquid can find no place to escape and the pressure between the discharging side of the helm pump 10 and the suction side of the hydraulic pump 30 increases as the helm pump 10 continues to rotate. As the rotating speed increases in comparison to the differential pressure signal, discharging flow rate of the hydraulic pump 30 increases beyond the range of increasing the discharging flow rate of the helm pump 10, the pressure between the discharging side of the helm pump 10 and the suction side of the hydraulic pump 30 decreases.

The operation will be described quantitatively below.

Figure 21:
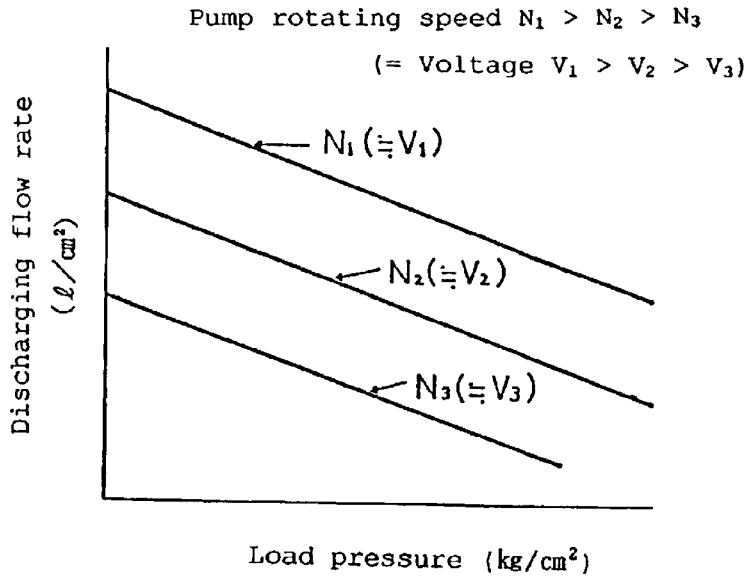
Figure 22:
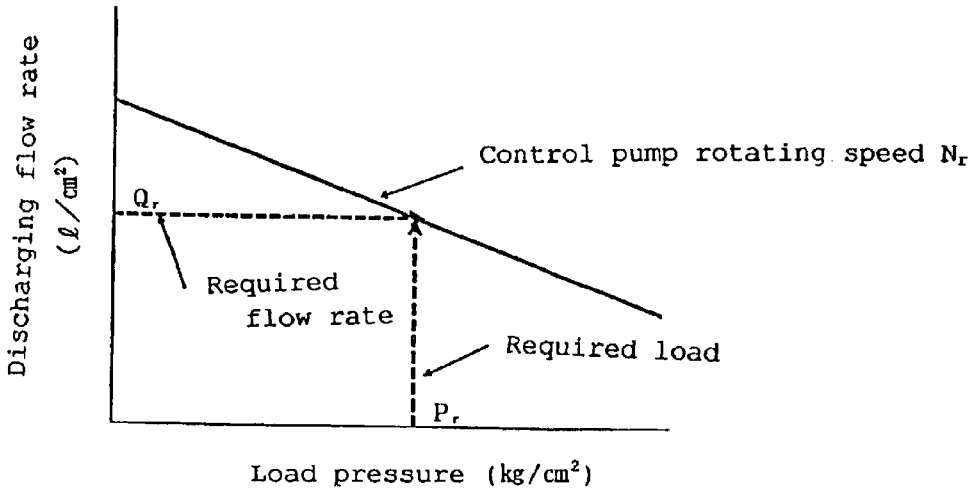

FIG. 21 shows the relationship of the load pressure to the discharge flow rate for different values of rotating speed N of the hydraulic pump. The discharge flow rate increases as the rotating speed N (voltage V) of the hydraulic pump increases. On the other hand, even when the rotating speed N remains constant, to the discharge flow rate decreases as the load pressure increases. When it is desired to move the piston rod with the discharge flow rate $Q_r$ (equal to discharging flow rate of the helm pump 10) when a load pressure $P_r$ is required, it suffices to rotate at the speed $N_r$ that is given by the intercept of the load pressure $P_r$ plotted along the abscissa and the discharge flow rate $Q_r$ plotted along the ordinate as shown in FIG. 22.

Now the value of signal of the pressure detector that is input to determine the rotating speed $N_r$ is obtained. For an apparatus that includes a pump motor and a hydraulic pump, control block diagram that is used for the analysis of control performance is used to determine the relationship between the pressure difference $P_i$ of two pressure detectors to be input to the pump motor, load pressure $P_r$ and required rotating speed $N_r$ (related to the rotating speed of the helm pump).

Figure 23:
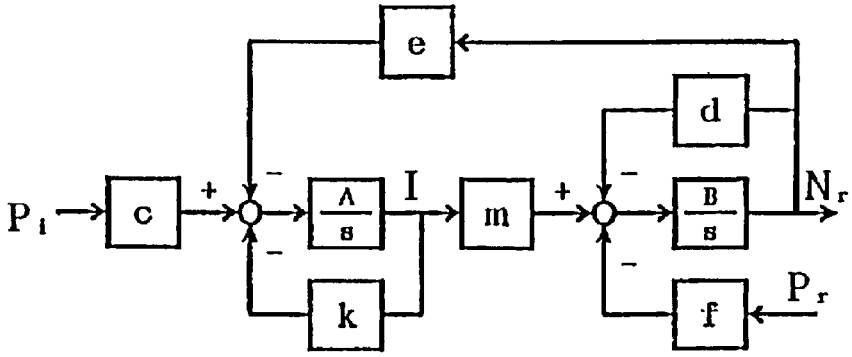

FIG. 23 is a control block diagram that shows the relation between the pressure difference $P_i$, load pressure $P_r$ and rotating speed $N_r$. s is Laplacian, A, B, d, e, f, m and k are constants that are specific to the apparatus, and C is a selectable constant that can be changed to determine the pressure difference $P_i$ that is required. The relation between the pressure difference $P_i$, load pressure $P_r$ and rotating speed $N_r$ is expressed as formula 1 (Laplacian s=0 in steady state and therefore not represented in formula 1) under the condition that the helm pump rotates at a constant speed (referred to as the steady state). This formula gives the value of pressure difference $P_i$ to determine the rotating speed $N_r$ of the hydraulic pump that discharges a specified flow rate, when the discharging flow rate is determined by rotating the helm pump at a certain rotating speed under a load Pr.

$$P_i 32\ \{N_r(me+dk)+P_r fk\}/cm \qquad \text{Equation 1}$$

Value of $P_i$ in steady state (s→0)

In FIG. 23, the product of pressure difference Pi and constant C is taken as the input to the pump motor. The pressure difference Pi is the pressure generated in the helm pump by rotating the helm pump, a larger value of pressure difference Pi means that the steering wheel must be turned with larger torque.

Figure 24:
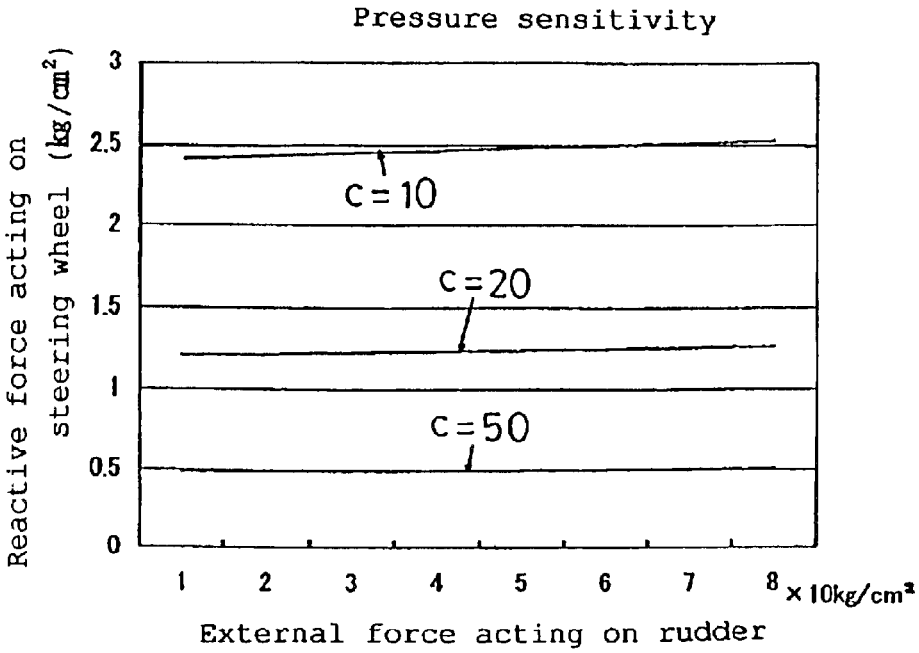

On the other hand, formula 1 shows that pressure difference Pi is affected by the load pressure $P_r$. That is, the load pressure $P_r$ is transmitted to the steersman as the torque of the steering wheel. FIG. 24 shows the relation between the pressure difference Pi and the load pressure $P_r$ when a servo motor having an output power of about 500 W used as the pump motor is operated at a constant speed of 5000 revolutions per minute with the value of C set to 10, 20 and 50. The result means the following.

① Torque of the steering wheel that corresponds to the pressure difference Pi given by the helm pump can be freely determined in accordance to the value of C.

② Torque of the steering wheel that corresponds to the pressure difference Pi given by the helm pump decreases as the value of C increases.

③ The pressure difference Pi shows less fluctuation as the load varies, when the value of C remains constant.

However, steering operation may be easier when larger variation of the load pressure $P_r$ is felt in some cases. That is, the helm pump may be rotated to fast thereby turning the steering wheel too sharply, in case an increase in the load pressure $P_r$ cannot be felt by the steersman as an change in the torque of the steering wheel. Particularly when the ship travels at a high speed, steering operation produces sharper response but the resistance against the steering operation increases, and steersmen pay care not to steer too sharply when the reactive force is felt during manual steering. With this practice, however, there is a possibility of steering sharply since the steersman feels small variations in the reactive force.

FIG. 25 shows a control system that enables it to feel larger reactive force than with the method described above.

Constants a and b in FIG. 25 are selectable and other symbols have the same meaning as those in FIG. 23. FIG. 25 is a block diagram of control wherein pressure difference signal and current of the pump motor are compared and the pump motor is controlled to rotate using the difference signal. The current of the pump motor is a physical quantity that is proportional to the output torque of the motor, and this quantity is compared with the pressure difference signal (resistive pressure) by converting the pressure difference signal to a value of torque to be developed by the pump motor, and this value is used as the command signal of the pump motor. The relation between the pressure difference Pi, load pressure $P_r$ and rotating speed $N_r$ under steady state is expressed as formula 2.

$$P_i=[N_r\{me+d(b+k)\}+P_r f(b+k)]/abm \qquad \text{Equation 2}$$

Value of $P_i$ in steady state (s→0)

FIG. 26 shows the relation between the pressure difference Pi and the load pressure $P_r$ under the same conditions as those for FIG. 23, namely when a DC servo motor having an output power of 500 W is operated at a constant speed of 5000 revolutions per minute with the value of b set to 10, 20 and 50, with fixed value of a=10.

Comparison of the graphs of FIG. 24 and FIG. 26, which are plotted against the abscissa and ordinate of the same scales, shows that the pressure difference $P_i$ shows larger variations as the load pressure $P_r$ varies in FIG. 26. That is, variations in the load on the rudder that represents the variations in the load pressure $P_r$ can be felt as a larger variation in the torque of the steering wheel by the steersman in this case than in the case of FIG. 24.

The reason for the above will be described below by means of formula 1 and formula 2. Comparison of the coefficient applied to the load pressure Pr between FIG. 23 and FIG. 25 shows fk for FIG. 23 and f(k+b) for FIG. 25. f and k are constants specific to the apparatus that cannot be changed, while b can be freely set. By giving a proper value to the constant b, the steersman can be provided with a preferable change in the torque of the steering wheel. Principle of this method is shown in FIG. 2.

Based on the discussion described above, it can be concluded that the method shown in FIG. 23 should be used when such a control is desired as the variation in load on the steering wheel is not felt significantly, and the method shown in FIG. 25 should be used when such a control is desired as the variation in load on the steering wheel is felt sharply. Hereinafter the method shown in FIG. 23 will be called the pressure control method and the method shown in FIG. 25 will be called the torque control method.

The control block diagram shown in FIG. 23 or FIG. 25 represents a control system that where the pressure difference Pi that is the output signal of the pressure detector is used as the control value so as to maintain a constant speed of the rudder 27. Response of this control system to a variation in the load pressure $P_r$ applied to the rudder 27 when the helm pump 10 rotates at a constant rotating speed will be described below with reference to FIG. 27.

Figure 27:
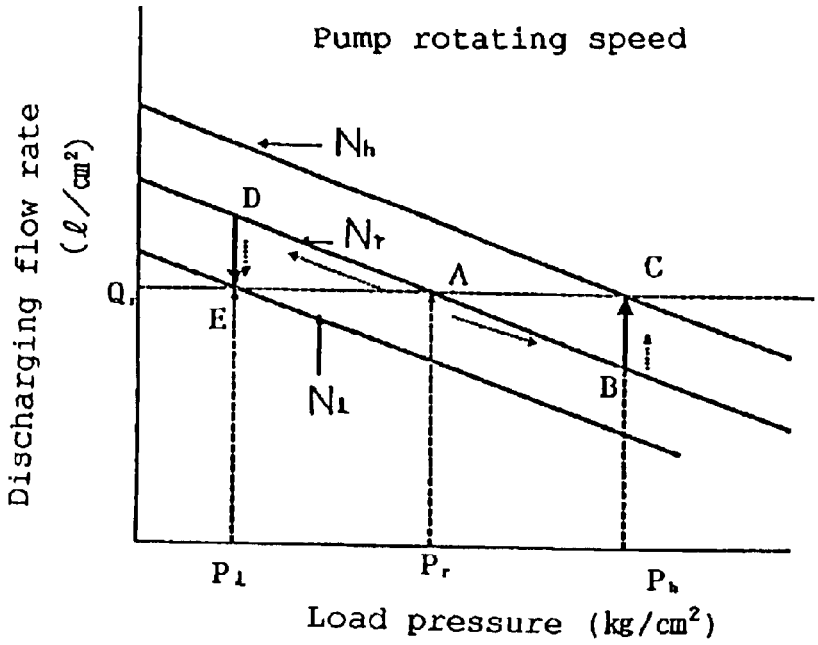
Figure 28:
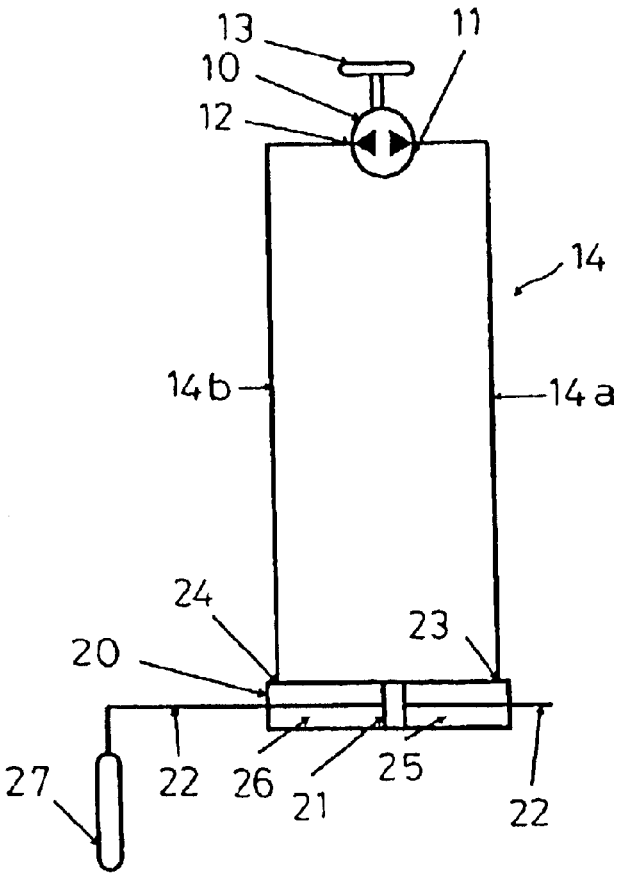
FIG.28 (Prior Art)
FIG. 28 shows schematic constitution of an example of the prior art manual steering apparatus.
Figure 29:
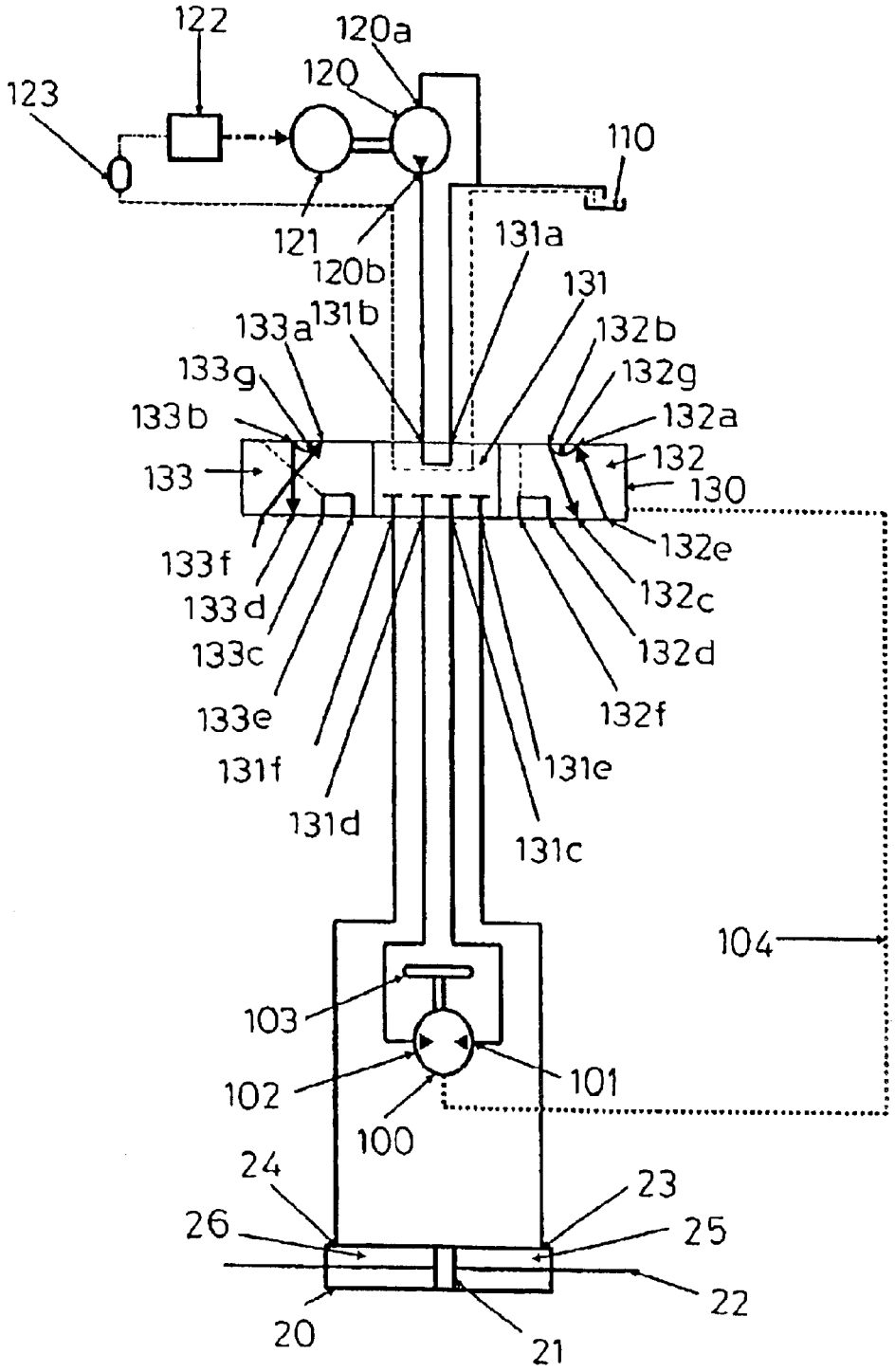
FIG. 29 (Prior Art)
FIG. 29 through FIG. 31 shows schematic constitution of an example of the prior art power-assisted steering apparatus.
Figure 30:
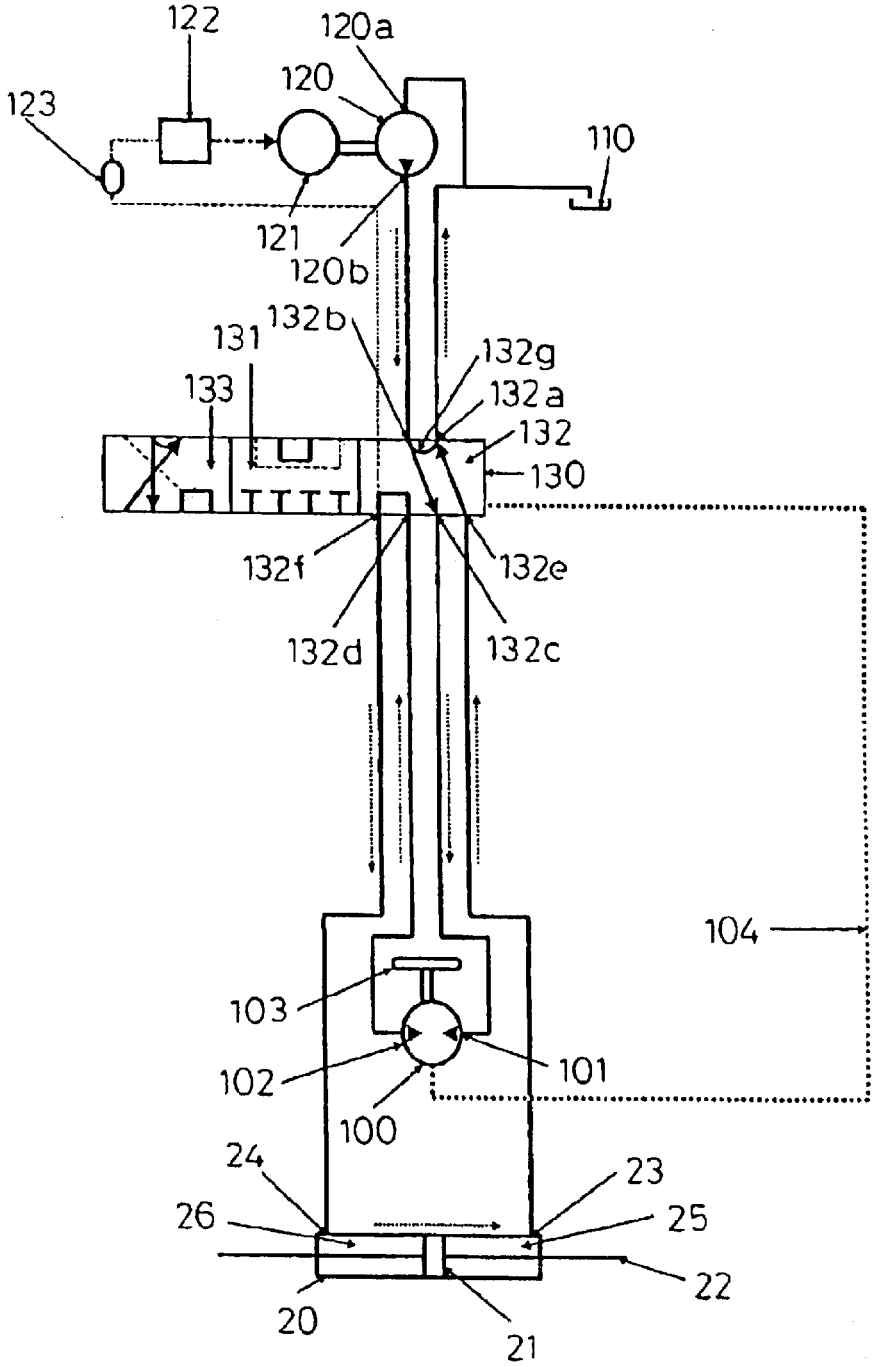
FIG.30 (Prior Art)
Figure 31:
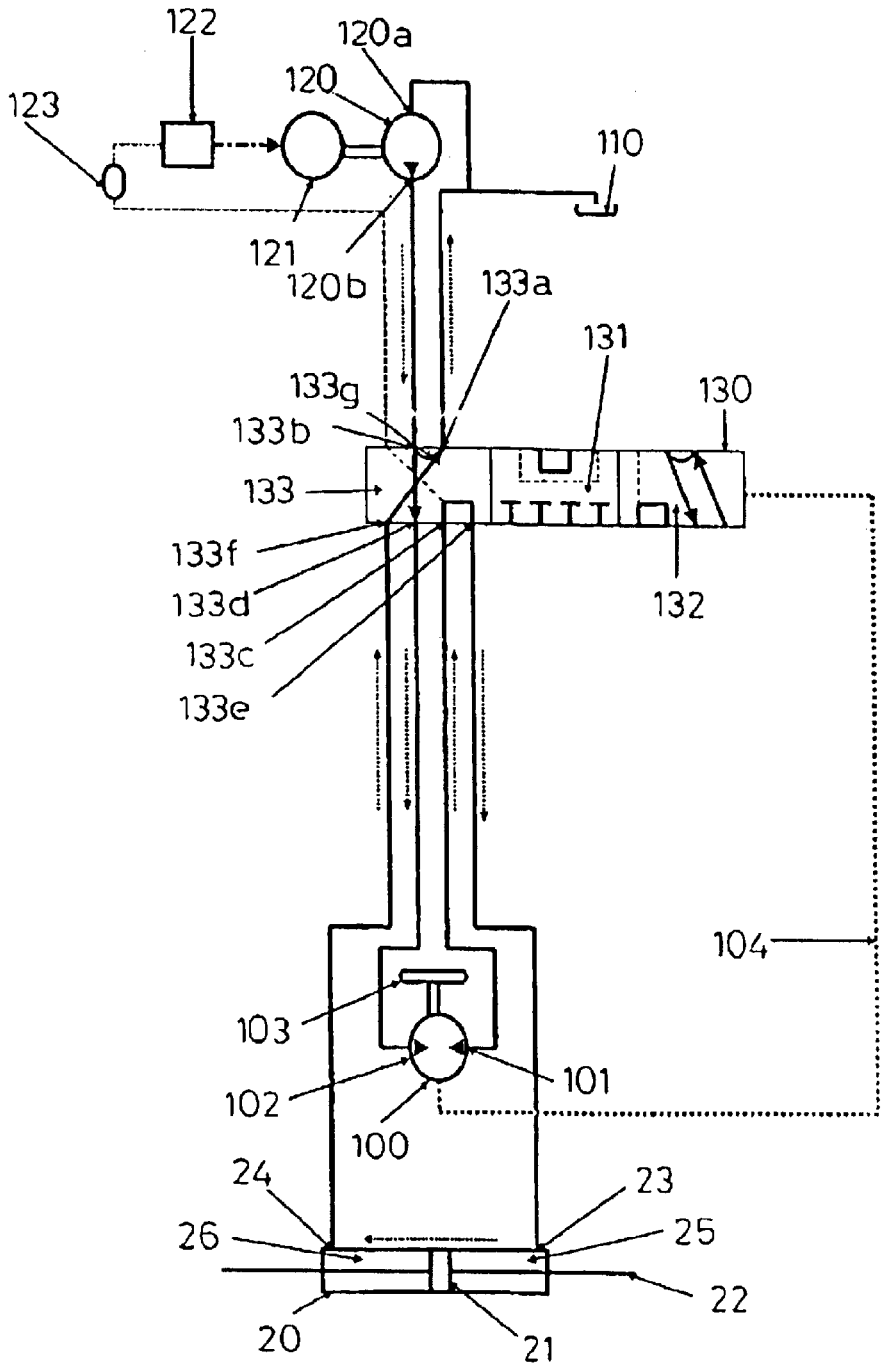
FIG. 31 (Prior Art)

Assume the discharge flow rate of $Q_r$ when the helm pump 10 rotates at a constant rotating speed, the load pressure of the rudder 27 is Pr and rotating speed of the hydraulic pump at this time is $N_r$ (point A in FIG. 27). When the load pressure increases to $P_h$, the flow rate decreases along the curve of the rotating speed $N_r$ as indicated by the arrow (point B in FIG. 27) since the rotating speed $N_r$ does not changed. When the discharge flow rate $Q_r$ of the hydraulic pump decreases, pressure on the discharging side of the helm pump 10 increases since the rotating speed of the helm pump 10 does not change. Therefore, the pressure difference $P_i$ increases and the rotating speed $N_r$ of the pump motor 40 increases so that the discharging flow rate of the discharging flow rate of the hydraulic pump $Q_r$ increases for the control to return to the initial flow rate (point C in FIG.

27). For this control to be carried out satisfactorily, it is important that the helm pump 10 is kept to rotate always at a constant speed. That is, when the load pressure $P_r$ increases, the steersman must supply the energy related to the increase in pressure on the discharging side of the helm pump 10. Therefore, torque must be increased in order to maintain the rotating speed $N_r$ constant, regardless of the increase in the load pressure $P_r$. This increase is very small in the case of the pressure control method compared to the case of the torque control method, as shown in FIG. 24 and FIG. 26. When the load pressure decreases to $P_i$, the path from A, D to E in FIG. 27 is followed.

In the control operation described above, pressure difference Pi generated by the helm pump 10 is determined as the difference between the measurements by the two pressure detectors 50, 51 that are installed at the discharging side and suction side of the helm pump 10. By properly modifying the apparatus, it is made possible to set the pressure on the suction side of the helm pump 10 to the atmospheric pressure (0 kg/cm$^2$). In this case, one of the pressure detector and the pressure subtraction circuit can be omitted.

INDUSTRIAL APPLICABILITY

As described above, the steering apparatus of the present invention can be used as hydraulic steering apparatuses such as oil hydraulic steering apparatus for ships.

What is claimed is:

1. A steering apparatus comprising steering means including a steering wheel 13 and a helm pump 10 that can be rotated through desired angles of rotation in both the forward and reverse directions by operating said steering wheel 13 and discharges a liquid of a quantity proportional to said angles of rotation, and double action cylinder means comprising a cylinder 20, a piston 21 and a piston rod 22 provided on a rudder side of the ship as means for moving a rudder 27, said steering means and said double action cylinder means being connected with each other by means of a closed hydraulic circuit, so that the entire liquid that is discharged from the helm pump 10 is introduced via the hydraulic circuit into one chamber of the cylinder 20 of the double action cylinder means and the same amount of liquid is discharged from the other chamber of the cylinder 20 so as to flow through the hydraulic circuit into the helm pump 10, thus constituting said closed hydraulic circuit having fully closed circuit construction as a whole for moving the rudder 27 by an amount corresponding to the amount of liquid introduced into said cylinder 20, wherein said steering apparatus further includes pump means for generating a discharging pressure in the same direction as the discharging direction from the helm pump 10 against the resistive pressure from said closed hydraulic circuit generated during rotation of the helm pump 10 due to the operation of said steering wheel 13 is installed in series in part of the fully closed hydraulic circuit, so that the steering resistance of the steering wheel 13 is automatically reduced by said pump means.

2. The steering apparatus according to claim 1, wherein a hydraulic circuit 14 comprising a pair of hydraulic circuits 14*a*, 14*b* connecting said steering means and the double action cylinder means is provided as said hydraulic circuit so that the entire liquid that is discharged from the helm pump 10 is introduced via one of said pair of hydraulic circuits 14*a*, 14*b* into one chamber of the cylinder 20 and the same amount of liquid is discharged from the other chamber of the cylinder 20 so as to flow through the other one of said pair of hydraulic circuits 14*a*, 14*b* into the helm pump 10, thus constituting the hydraulic circuit 14 having fully closed circuit constitution as a whole and moving the rudder 27 by an amount corresponding to the amount of liquid introduced into said cylinder 20, wherein at least a hydraulic pump 30 capable of discharging in both ways is provided as said pump means, and said hydraulic pump 30 capable of discharging in both ways is installed in series in part of the fully closed hydraulic circuit, so that the steering resistance of the steering wheel 13 is automatically reduced by applying discharging pressure in the same direction as the discharging direction of the helm pump 10 corresponding to the operation of the steering wheel 13 by means of the assistance of said pump means that includes said hydraulic pump 30.

3. The steering apparatus according to claim 2, wherein the pump means that generates discharging pressure in the same direction as the discharging direction of the helm pump 10 has a pressure detector that detects the resistive pressure received when the helm pump 10 rotates to discharge the liquid, so that a motor drive circuit 41 of the hydraulic pump 30 is controlled with the discharging pressure that corresponds to the resistive pressure detected by said pressure detector.

4. The steering apparatus according to claim 2, wherein the pump means that generates discharging pressure in the same direction as the discharging direction from the helm pump 10 has a pressure detector that detects the resistive pressure received when the helm pump 10 rotates to discharge the liquid and a current detector that detects motor current of the hydraulic pump 30, so that the resistive pressure detected by the pressure detector and the actual discharging pressure of the hydraulic pump 30 detected by the current detector are compared and a motor drive circuit 41 of the hydraulic pump 30 is controlled according to the difference.

5. The steering apparatus according to claim 1, wherein a hydraulic circuit 14 comprising a pair of hydraulic circuits 14*a*, 14*b* connecting said steering means and the double action cylinder means is provided as said hydraulic circuit so that the entire liquid that is discharged from said helm pump 10 is introduced via one of said pair of hydraulic circuits 14*a*, 14*b* into one chamber of the cylinder 20 and the same amount of liquid is discharged from the other chamber of the cylinder 20 so as to flow through the other one of said pair of hydraulic circuits 14*a*, 14*b* into the helm pump 10, thus constituting the hydraulic circuit 14 having fully closed circuit constitution as a whole and moving the rudder 27 by an amount corresponding to the amount of liquid introduced into said cylinder 20, wherein at least a pair of hydraulic pumps 30, 31 capable of discharging in both ways are provided as said pump means, and said pair of hydraulic pumps 30, 31 capable of discharging in both ways are installed in series in of said pair of hydraulic circuits 14*a*, 14*b* of the fully closed hydraulic circuit 14, so that the steering resistance of the steering wheel 13 is automatically reduced by applying the discharging pressure in the same direction as discharging direction from the helm pump 10 corresponding to the operation of the steering wheel 13 by means of said pump means including said pair of hydraulic pumps 30, 31.

6. The steering apparatus according to claim 5, wherein the pump means that generates the discharging pressure in the same direction as the discharging direction from the helm pump 10 has a pressure detector that detects the resistive pressure received when the helm pump 10 rotates to discharge the liquid, so that a motor drive circuit 41 that drives both the pair of hydraulic pumps 30, 31 is controlled with the discharging pressure that corresponds to the resistive pressure detected by said pressure detector.

7. The steering apparatus according to claim 5, wherein the pump means that generates the discharging pressure in the same direction as the discharging direction from the helm pump 10 has a pressure detector that detects the resistive pressure received when the helm pump 10 rotates to discharge the liquid and a current detector that detects motor current of the pair of hydraulic pumps 30, 31, so that the resistive pressure detected by the pressure detector and the actual discharging pressure of the hydraulic pumps 30, 31 detected by the current detector are compared and a motor drive circuit 41 of the pair of hydraulic pumps 30, 31 is controlled according to the difference.

8. The steering apparatus according to claim 1, further including a hydraulic pump 32 capable of discharging in only one direction is provided as said pump means, said hydraulic pump 32 being installed in series in part of said fully closed hydraulic circuit 15, and a passage switching means installed between said hydraulic pump 32 and said helm pump 10 that switches the passage amid said hydraulic circuit 15 according to the direction of discharging the liquid from said helm pump 10 thereby to connect the liquid from the helm pump 10 to the suction side of said hydraulic pump 32 regardless of which direction said helm pump 10 discharges, so that the steering resistance of the steering wheel 13 is automatically reduced by applying the discharging pressure in the same direction as the discharging direction from the helm pump 10 corresponding to the operation of the steering wheel 13 by means of the assistance of said pump means that includes said hydraulic pump 32 and said passage switching means.

9. The steering apparatus as described in claim 8, wherein the pump means that generates the discharging pressure in the same direction as the discharging direction from the helm pump 10 has a pressure detector that detects the resistive pressure received when the helm pump 10 rotates to discharge the liquid and a current detector that detects motor current of the hydraulic pump 32, so that the resistive pressure detected by the pressure detector and the actual discharging pressure of the hydraulic pump 32 detected by the current detector are compared and a motor drive circuit 41 of the hydraulic pump 32 is controlled according to the difference.

10. A steering apparatus comprising steering means including a steering wheel 13 and a helm pump 10 that can be rotated through desired angles of rotation in both the forward and reverse directions by operating said steering wheel 13 and discharges a liquid of a quantity proportional to said angles of rotation, and double action cylinder means comprising a cylinder 20, a piston 21 and a piston rod 22 provided on a rudder side of the ship as means for moving a rudder 27, said steering means and said double action cylinder means being connected with each other by means of a closed hydraulic circuit, so that the entire liquid that is discharged from the helm pump 10 is introduced via the hydraulic circuit into one chamber of the cylinder 20 of the double action cylinder means and the same amount of liquid is discharged from the other chamber of the cylinder 20 so as to flow through the hydraulic circuit into the helm pump 10, thus constituting said closed hydraulic circuit having fully closed circuit construction as a whole for moving the rudder 27 by an amount corresponding to the amount of liquid introduced into said cylinder 20, wherein said steering apparatus further includes pump means for generating a discharging pressure in the same direction as the discharging direction from the helm pump 10 against the resistive pressure from said closed hydraulic circuit generated during rotation of the helm pump 10 due to the operation of said steering wheel 13 is installed in series in part of the fully closed hydraulic circuit, so that the steering resistance of the steering wheel 13 is automatically reduced by said pump means, further including a hydraulic pump 32 capable of discharging in only one direction is provided as said pump means, said hydraulic pump 32 being installed in series in part of said fully closed hydraulic circuit 15, and a passage switching means installed between said hydraulic pump 32 and said helm pump 10 that switches the passage amid said hydraulic circuit 15 according to the direction of discharging the liquid from said helm pump 10 thereby to connect the liquid from the helm pump 10 to the suction side of said hydraulic pump 32 regardless of which direction said helm pump 10 discharges, so that the steering resistance of the steering wheel 13 is automatically reduced by applying the discharging pressure in the same direction as the discharging direction from the helm pump 10 corresponding to the operation of the steering wheel 13 by means of the assistance of said pump means that includes said hydraulic pump 32 and said passage switching means, wherein the pump means that generates the discharging pressure in the same direction as the discharging direction from the helm pump 10 has a pressure detector that detects the resistive pressure received when the helm pump 10 rotates to discharge the liquid, so that a motor drive circuit 41 of the hydraulic pump 32 is controlled with the discharging pressure that corresponds to the resistive pressure detected by said pressure detector.

11. A steering apparatus having, in addition to the constitution of claim 1, a hydraulic circuit 14 comprising a pair of hydraulic circuits 14*a*, 14*b* connecting said steering means and the double action cylinder means provided as said hydraulic circuit so that the entire liquid that is discharged from said helm pump 10 is introduced via one of said pair of hydraulic circuits 14*a*, 14*b* into one chamber of the cylinder 20 and the same amount of liquid is discharged from the other chamber of the cylinder 20 so as to flow through the other one of said pair of hydraulic circuits 14*a*, 14*b* into the helm pump 10, thus constituting the hydraulic circuit 14 having fully closed circuit constitution as a whole and moving the rudder 27 by an amount corresponding to the amount of liquid introduced into said cylinder 20, wherein at least a hydraulic pump 32 capable of discharging only in one direction is provided as said pump means, said hydraulic pump 32 is installed in series in of said pair of hydraulic circuits 14*a*, 14*b* of the fully closed hydraulic circuit 14, a pair of passage switching means are installed between said hydraulic pump 32 and said helm pump 10 and between the hydraulic pump 32 and the cylinder 20 that switches the passage amid said hydraulic circuit 14 according to the direction of discharging the liquid from said helm pump 10 thereby to connect the liquid from the helm pump 10 to the suction side of said hydraulic pump 32 regardless of which direction said helm pump 10 discharges, so that the steering resistance of the steering wheel 13 is automatically reduced by applying the discharging pressure in the same direction as the discharging direction from the helm pump 10 corresponding to the operation of the steering wheel 13 by means of said pump means including said hydraulic pump 32 and said pair of passage switching means.

12. The steering apparatus according to claim 11, wherein the pump means that generates the discharging pressure in the same direction as the discharging direction from the helm pump 10 has a pressure detector that detects the resistive pressure received when the helm pump 10 rotates to discharge the liquid, so that a motor drive circuit 41 that drives both the hydraulic pump 32 is controlled with the discharging pressure that corresponds to the resistive pressure detected by said pressure detector.

13. The steering apparatus according to claim 11, wherein the pump means that generates the discharging pressure in the same direction as the discharging direction from the helm pump 10 has a pressure detector that detects the resistive pressure received when the helm pump 10 rotates to discharge the liquid, and a current detector that detects motor current of the hydraulic pump 32, so that the resistive pressure detected by the pressure detector and the actual discharging pressure of the hydraulic pump 32 detected by the current detector are compared and a motor drive circuit 41 of the hydraulic pump 32 is controlled according to the difference.

14. The steering apparatus according to claim 1, wherein a hydraulic circuit 14 comprising a pair of hydraulic circuits 14*a*, 14*b* connecting said steering means and the double action cylinder means is provided as said hydraulic circuit so that the entire liquid that is discharged from said helm pump 10 is introduced via one of said pair of hydraulic circuits 14*a*, 14*b* into one chamber of the cylinder 20 and the same amount of liquid is discharged from the other chamber of the cylinder 20 so as to flow through the other one of said pair of hydraulic circuits 14*a*, 14*b* into the helm pump 10, thus constituting the hydraulic circuit 14 having fully closed circuit constitution as a whole and moving the rudder 27 by an amount corresponding to the amount of liquid introduced into said cylinder 20, wherein at least a pair of hydraulic pumps 33, 34 capable of discharging only in one direction are provided as said pump means, and said pair of hydraulic pumps 33, 34 capable of discharging only in one direction are installed in series in said pair of hydraulic circuits 14*a*, 14*b* of the fully closed hydraulic circuit 14, so that the resistance against the operation of the steering wheel 13 is automatically reduced by driving either one of said pair of hydraulic pumps 33, 34 in accordance to the direction of discharging the liquid from the helm pump 10 due to the operation of the steering wheel 13 and applying the discharging pressure in the same direction as the discharging direction from the helm pump 10 corresponding to the operation of the steering wheel 13.

15. The steering apparatus according to claim 14, wherein the pump means that generates the discharging pressure in the same direction as the discharging direction from the helm pump 10 has a pressure detector that detects the resistive pressure received when the helm pump 10 rotates to discharge the liquid, so that a motor drive circuit 41 that drives the hydraulic pumps 33, 34 is controlled with the discharging pressure that corresponds to the resistive pressure detected by said pressure detector.

16. The steering apparatus according to claim 14, wherein the pump means that generates the discharging pressure in the same direction as the discharging direction from the helm pump 10 has a pressure detector that detects the resistive pressure received when the helm pump 10 rotates to discharge the liquid, and a current detector that detects motor current of the hydraulic pumps 33, 34, so that the resistive pressure detected by the pressure detector and the actual discharging pressure of the hydraulic pumps 33, 34 detected by the current detector are compared and a motor drive circuit 41 of the hydraulic pumps 33, 34 is controlled according to the difference.

* * * * *